US009315017B2

(12) United States Patent
Fukazawa et al.

(10) Patent No.: US 9,315,017 B2
(45) Date of Patent: Apr. 19, 2016

(54) RECORDING APPARATUS AND RECORDING METHOD

(71) Applicant: Seiko Epson Corporation, Tokyo (JP)

(72) Inventors: Masahiro Fukazawa, Chino (JP); Naoki Sudo, Shiojiri (JP); Akito Sato, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/690,846

(22) Filed: Apr. 20, 2015

(65) Prior Publication Data

US 2015/0298454 A1 Oct. 22, 2015

(30) Foreign Application Priority Data

Apr. 21, 2014 (JP) ..... 2014-087026

(51) Int. Cl.

| | |
|---|---|
| ***B41J 29/393*** | (2006.01) |
| ***B41J 2/045*** | (2006.01) |
| *B41J 2/21* | (2006.01) |
| *B41J 2/14* | (2006.01) |

(52) U.S. Cl.

CPC ..... *B41J 2/0451* (2013.01); *B41J 2/04541* (2013.01); *B41J 2/04581* (2013.01); *B41J 2/2132* (2013.01); *B41J 2/2139* (2013.01); *B41J 2/2146* (2013.01); *B41J 2/04586* (2013.01); *B41J 2/2135* (2013.01); *B41J 2/2142* (2013.01); *B41J 2002/14354* (2013.01)

(58) Field of Classification Search

None

See application file for complete search history.

(56) References Cited

U.S. PATENT DOCUMENTS

| | | | | |
|---|---|---|---|---|
| 7,387,361 | B1 * | 6/2008 | Rueby et al. | 347/41 |
| 7,585,045 | B2 | 9/2009 | Yamanobe | |
| 7,681,973 | B2 | 3/2010 | Uji et al. | |
| 2007/0211101 | A1 * | 9/2007 | Yamanobe | B41J 2/04508 347/19 |

FOREIGN PATENT DOCUMENTS

| | | | |
|---|---|---|---|
| JP | 2008-155382 | A | 7/2008 |
| JP | 2011255594 | A * | 12/2011 |
| JP | 2012-187931 | A | 10/2012 |

OTHER PUBLICATIONS

Machine Translation of JP 2011255594A, Dec. 22, 2011, Paragraphs 0021, 0027, 0081-0085.*

* cited by examiner

*Primary Examiner* — Lisa M Solomon

(74) *Attorney, Agent, or Firm* — Harness, Dickey & Pierce, P.L.C.

(57) ABSTRACT

A recording apparatus includes a first nozzle row and a second nozzle row. A part of nozzles of the first nozzle row and the second nozzle row are overlapped in a predetermined alignment direction. A defective nozzle is included in the nozzles of the first nozzle row. The recording apparatus includes a processing unit that causes the nozzle closest to the defective nozzle in one side of the opposite sides in the alignment direction to be selected as a first complementary nozzle and the closest nozzle in the other side thereof to be selected as a second complementary nozzle among the nozzles in an overlap section of the second nozzle row with the first nozzle row, and complementary dots that complement a dot which is supposed to be formed by the defective nozzle to be formed by the first complementary nozzle and the second complementary nozzle.

7 Claims, 15 Drawing Sheets

COMPARATIVE EXAMPLE

RECORDING APPARATUS AND RECORDING METHOD

CROSS-REFERENCE TO RELATED APPLICATIONS

This application claims priority to Japanese Patent Application No. 2014-087026 filed on Apr. 21, 2014. The entire disclosure of Japanese Patent Application No. 2014-087026 is hereby incorporated herein by reference.

BACKGROUND

1. Technical Field

The present invention relates to a recording apparatus and a recording method.

2. Related Art

An ink jet printer, for example, causes a plurality of nozzles aligned in a predetermined nozzle alignment direction and a print substrate (recording substrate) to relatively move in a relative movement direction intersecting with the nozzle alignment direction, an ink droplet (liquid droplet) is discharged from the nozzle in accordance with nozzle data indicating presence or absence of a dot for each pixel, and dots are formed on the print substrate. In addition, in order to perform printing rapidly, a line printer has been known, in which the print substrate is transported without moving nozzles aligned across substantially an entire width of the print substrate in a width direction intersecting with a transport direction of the print substrate, and a printed image is formed. In order to align the nozzles substantially all across the print substrate in the width direction, the line printer uses a plurality of chips (recording heads) which have a nozzle row and the nozzles aligned in a joined section of two adjacent chips are overlapped in some cases. In a case where the nozzles are partially overlapped, the print substrate has a solo region in which a dot is formed by one nozzle and an overlap region in which a dot is formed by a plurality of nozzles.

When the ink droplet is not discharged from the nozzle due to clogging or the like or the discharged ink droplet does not draw a correct trajectory, a "dot deficient" region in which pixels by which dots are not formed are continuous in the relative movement direction is formed and a streak of a white line is produced on a printed image. In order to prevent this streak, there has been an attempt that a complementary dot that complements a dot which is supposed to be formed by a defective nozzle is formed by a complementary nozzle.

Further, although a dot formed by the defective nozzle is not complemented in technology, JP-A-2012-187931 discloses an ink jet recording apparatus that selects, as an overlapping nozzle, a nozzle which has the minimum shift length in the alignment direction of the nozzles from nozzles positioned in a linked portion of chips (N) and (N+1). Hence, in the linked portion of the chips (N) and (N+1), there is only one nozzle in the chip (N+1) that is combined with nozzles of the chip (n).

JP-A-2012-187931 does not suggest that a dot formed by the defective nozzle is complemented. In addition, the selection of the nozzle has the minimum shift length in the alignment direction of the nozzles means that position adjustment is performed at a nozzle pitch unit in the alignment direction of the nozzles and a streak of unevenness is produced on a printed image in the relative movement direction due to an error less than the nozzle pitch remaining between the nozzles of chips (N) and (N+1). Hence, the technology disclosed in JP-A-2012-187931 does not reach an appropriate technology in which a dot formed by the defective nozzle in the linked portion of the chips is complemented.

Various recording apparatuses have the same problems as described above.

SUMMARY

An advantage of some aspects of the invention is to provide a technology in which a dot formed by a defective nozzle which forms a defective dot can be more appropriately complemented.

According to an aspect of the invention, there is provided a recording apparatus that includes a plurality of nozzle rows in which a plurality of nozzles are aligned in a predetermined alignment direction, a part of the nozzles of a first nozzle row and a second nozzle row which are included in the plurality of nozzle rows are overlapped in the alignment direction, and the plurality of nozzle rows and a recording substrate relatively move in a relative movement direction different from the alignment direction. A defective nozzle which forms a defective dot is included in the nozzles in an overlap section of the first nozzle row with the second nozzle row. The recording apparatus includes a processing unit that causes the nozzle closest to the defective nozzle in one side of the opposite sides in the alignment direction to be selected as a first complementary nozzle and the closest nozzle in the other side thereof to be selected as a second complementary nozzle among the nozzles in the overlap section of the second nozzle row with the first nozzle row, in positions in the alignment direction, and a complementary dot that complements a dot which is supposed to be formed by the defective nozzle to be formed by the first complementary nozzle and the second complementary nozzle.

According to the aspect, it is possible to provide a technology in which a dot formed by a defective nozzle which forms a defective dot can be more appropriately complemented.

Further, it is possible to apply the invention to a multifunction apparatus including a recording apparatus, a recording method including a process corresponding to each unit described above, a processing method for the multifunction apparatus including the recording method, a recording program that causes a computer to execute a function corresponding to each unit described above, a processing program for the multifunction apparatus including the recording program, a computer readable medium in which these programs are recorded, or the like. The apparatus described above may be configured to include a plurality of scattered components.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
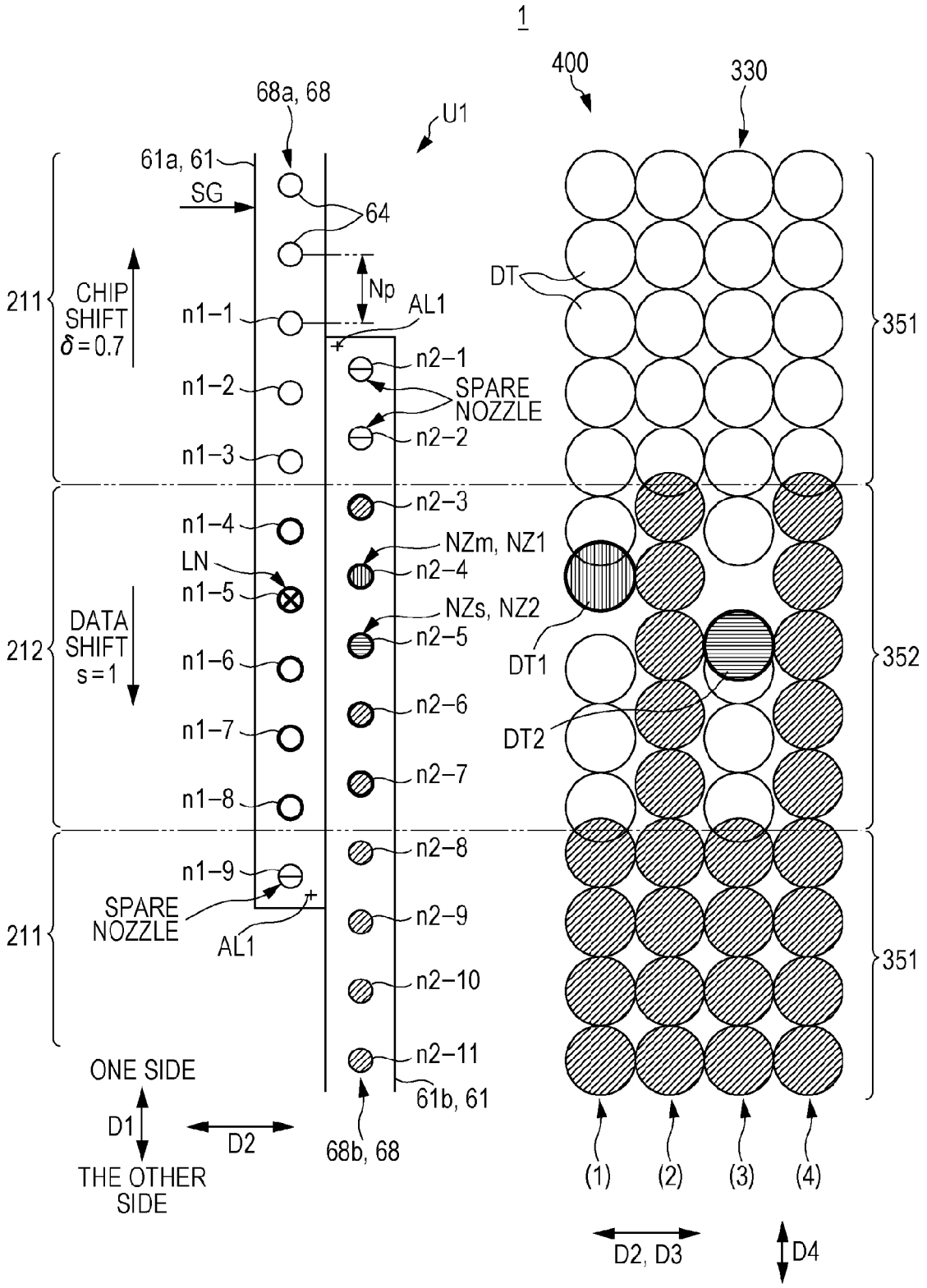
FIG. 1 is a view schematically illustrating an example of dot complementing when there is a shift between chips in an alignment direction.

Hereinafter, embodiments of the invention will be described. Needless to say, the following embodiments are only provided as an example of the invention; thus, the characteristics of the provided embodiments are not entirely necessary for the invention.

(1) OUTLINE OF TECHNOLOGY

First, the outline of the technology is described with reference to FIGS. 1 to 14.

A recording apparatus 1 illustrated in FIGS. 1 to 4 or the like includes a plurality of nozzle rows 68 in which a plurality of nozzles 64 are aligned in a predetermined alignment direction D1. A part of the nozzles of a first nozzle row 68*a* and a second nozzle row 68*b* which are included in the plurality of nozzle rows 68 are overlapped in the alignment direction D1. The plurality of nozzle rows and a recording substrate 400 relatively move in a relative movement direction D2 different from the alignment direction D1. A defective nozzle LN which forms a defective dot is included in the nozzles in an overlap section 212 of the first nozzle row 68*a* with the second nozzle row 68*b*. Here, among the nozzles in the overlap section 212 of the second nozzle row 68*b* with the second nozzle row 68*a*, in positions in the alignment direction D1, the nozzle closest to the defective nozzle LN in one side of the opposite sides in the alignment direction is selected as a first complementary nozzle NZ1 and the closest nozzle in the other side thereof is selected as a second complementary nozzle NZ2. The recording apparatus 1 includes a processing unit U1 that causes complementary dots DT1 and DT2 that complement a dot which is supposed to be formed by the defective nozzle LN to be formed by the first complementary nozzle NZ1 and the second complementary nozzle NZ2.

In addition, in a recording method according to the technology, a plurality of nozzle rows 68 in which a plurality of nozzles 64 are aligned in a predetermined alignment direction D1 are used and the plurality of nozzle rows 68 and a recording substrate 400 relatively move in a relative movement direction D2 different from the alignment direction D1. In the recording method, complementary dots DT1 and DT2 that complement a dot which is supposed to be formed by the defective nozzle LN are formed by the first complementary nozzle NZ1 and the second complementary nozzle NZ2.

Figure 15:
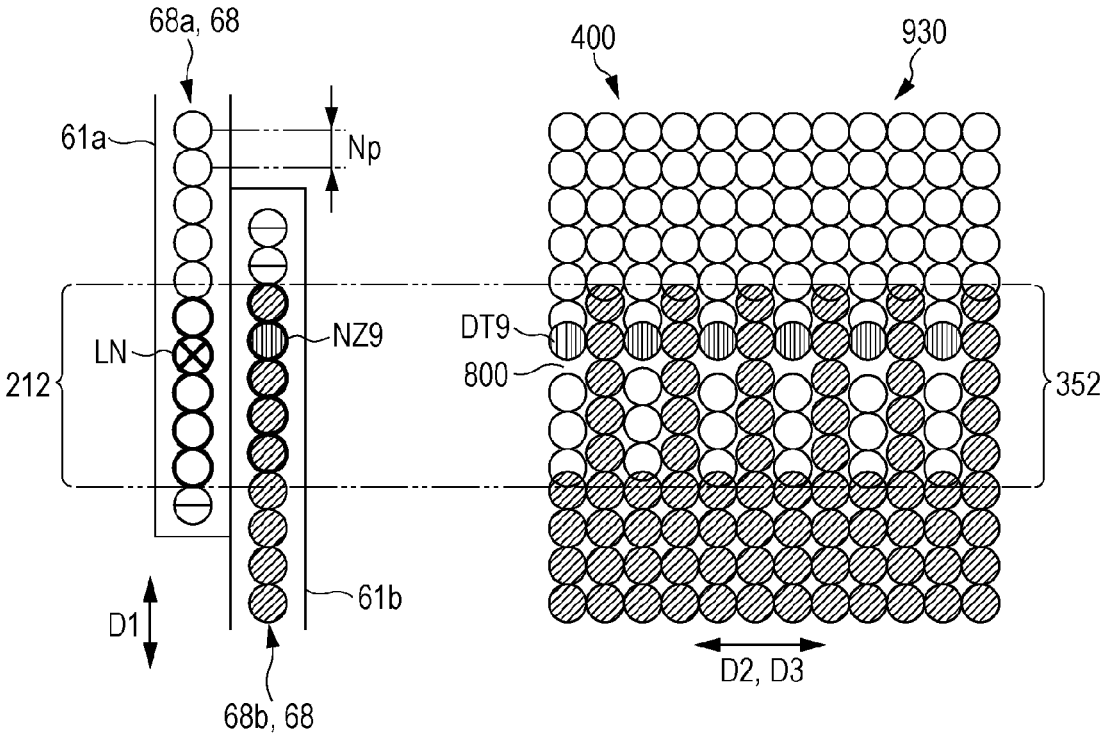
FIG. 15 is a view illustrating a printed image of a comparative example.

FIG. 15 schematically illustrates a comparative example in which the dot formed by the defective nozzle LN included in a chip 61*a* in the overlap section 212 is complemented only by a dot formed by a complementary nozzle NZ9 included in the chip 61*b*. The complementary nozzle NZ9 in the example is the nozzle closer to the defective nozzle LN in the positions in the alignment direction D1. In a case where the dots are formed to be continued in the relative movement direction D2, dots by the nozzles in the chip 61*a* and dots by the nozzles in the chip 61*b* are alternately formed in the overlap section 212.

When an error less than a nozzle pitch Np produced between the chips 61*a* and 61*b*, a programmed dot forming position by the defective nozzle LN in the alignment direction D1 and the dot formed position of a dot DT9 by the complementary nozzle NZ9 are shifted from each other. Therefore, a portion in which the dot DT9 by the complementary nozzle NZ9 in the chip 61*b* and the dot by a nozzle in the chip 61*a* are separated from each other in one pixel is produced in a printed image 930 and a steak of unevenness 800 is formed on the printed image 930 in the relative movement direction D2.

In the technology, as illustrated in FIG. 1, the complementary dots DT1 and DT2 that complements the dot formed by the defective nozzle LN included in the first nozzle row 68*a* are formed by the first complementary nozzle NZ1 and the second complementary nozzle NZ2 which have different positions in the alignment direction D1 in the second nozzle row 68*b*. Hence, according to the aspect described above, it is possible to provide a technology in which a dot formed by the defective nozzle can be appropriately complemented.

Here, the case where a plurality of nozzles and a recording substrate relatively move includes a case where the plurality of nozzles do not move but the recording substrate moves, a case where the recording substrate does not move but the plurality of nozzles move, and a case where both the plurality of nozzles but the recording substrate move. A representative example of the case where a plurality of nozzles do not move but a recording substrate moves when a liquid droplet is discharged and a dot is formed is a line printer. A nozzle is a small hole through which a liquid droplet (ink droplet) is ejected. A case where a liquid droplet fails to be discharged includes a case of clogging which is a phenomenon in which a nozzle is closed. A dot is the minimum unit of a recording result formed on a recording substrate by a liquid droplet.

Incidentally, as illustrated in FIGS. 9A to 10C, the processing unit U1 may set a ratio of a complementary dot DT1 formed by the first complementary nozzle NZ1 with respect to complementary dots DT1 and DT2 formed by the first complementary nozzle NZ1 and the second complementary nozzle NZ2 to be a ratio (distribution ratio Rm or Rs) obtained depending on a distance between the defective nozzle LN and the first complementary nozzle NZ1 in the alignment direction D1. FIGS. 9A to 10C show a ratio (distribution ratio Rm) assigned to a main complementary nozzle NZm and a ratio (distribution ratio Rs) assigned to a sub complementary nozzle NZs. In this aspect, a ratio of the complementary dots DT1 and DT2 formed by the first complementary nozzle NZ1 and the second complementary nozzle NZ2 which have different positions from each other in the alignment direction D1 becomes the ratio obtained depending on the distance between the defective nozzle LN and the first complementary nozzle NZ1 in the alignment direction D1. Therefore, it is possible to more appropriately complement the dot formed by the defective nozzle.

In addition, the processing unit may set a ratio (Rm) of complementary dots DT1 and DT2 formed by a nozzle (main complementary nozzle NZm) closer to the defective nozzle LN in positions in the alignment direction D1 between the first complementary nozzle NZ1 and the second complementary nozzle NZ2 to be higher than a ratio (Rs) of complementary dots DT1 and DT2 formed by a nozzle (sub complementary nozzle NZs) far from the defective nozzle LN. In this aspect, the ratio (Rm) of the complementary dots formed by the main complementary nozzle NZm closer to the defective nozzle LN in the positions in the alignment direction D1 becomes higher than the ratio (Rs) of the complementary dots formed by the sub complementary nozzle NZs far from the defective nozzle LN. Therefore, it is possible to more appropriately complement the dot formed by the defective nozzle.

Figure 5:
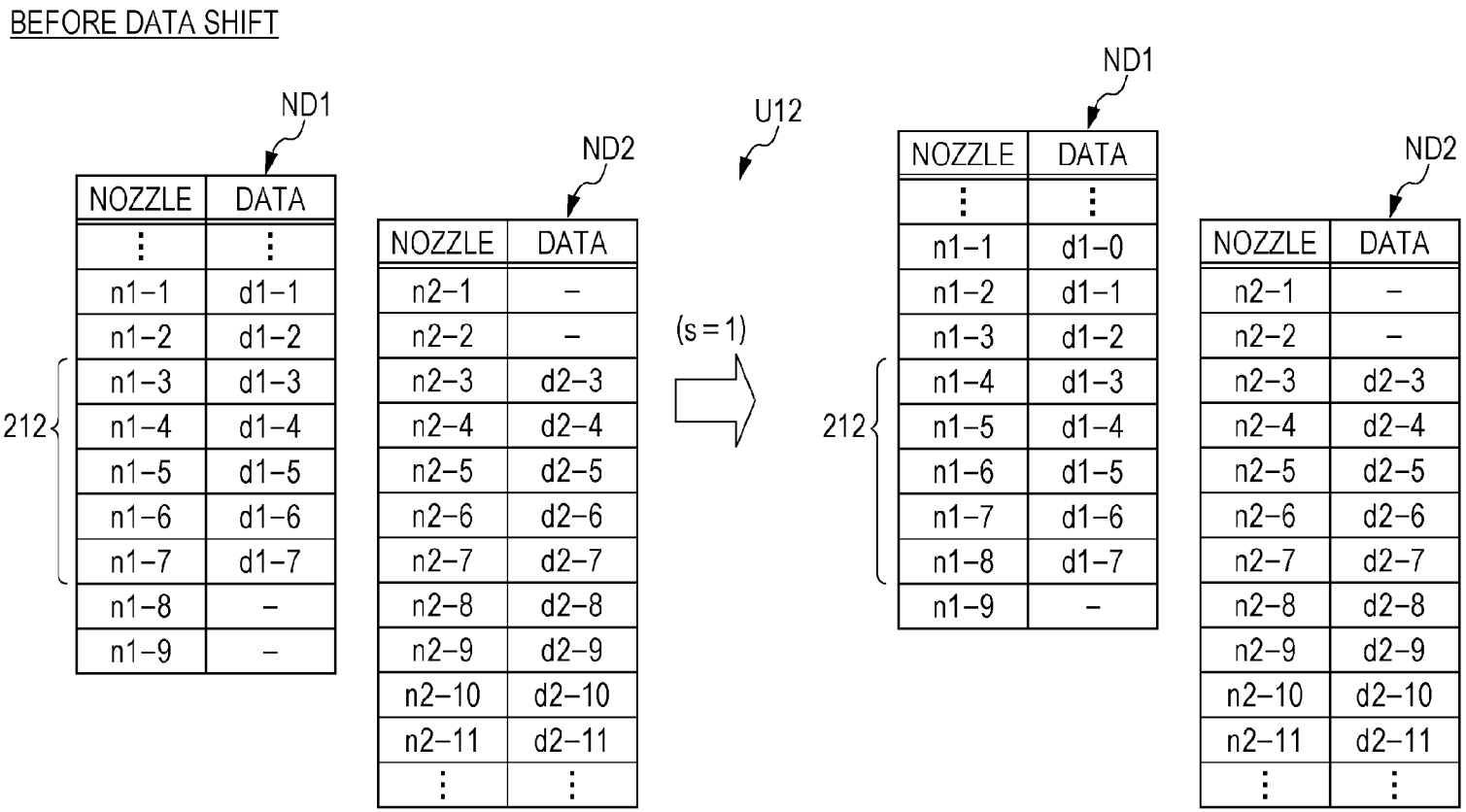
FIG. 5 is a diagram schematically illustrating a state in which first nozzle data and second nozzle data are relatively shifted.

As illustrated in FIG. 5, the processing unit U1 may include a data shift unit U12 that relatively shifts first nozzle data ND1 which enables a dot DT to be formed by the first nozzle row 68*a* and second nozzle data ND2 which enables a dot DT to be formed by the second nozzle row 68*b* in the alignment direction D1 at a nozzle unit and thereby, causes a shift of the first nozzle row 68*a* and the second nozzle row 68*b* in the alignment direction D1 to become smaller in data with respect to a reference. In addition, the processing unit U1 may form complementary dots DT1 and DT2 by the first complementary nozzle NZ1 and the second complementary nozzle NZ2 based on the relatively shifted first nozzle data ND1. In this aspect, a shift of the first nozzle row 68*a* and the second nozzle row 68*b* in the alignment direction D1 becomes smaller in the data with respect to a reference. Therefore, it is possible to provide an appropriate example in which the dot formed by the defective nozzle is complemented.

As illustrated in FIGS. 9A to 10C, the processing unit U1 may cause complementary dots DT1 and DT2 to be formed by the first complementary nozzle NZ1 and the second complementary nozzle NZ2 at a ratio obtained depending on an error length e obtained by subtracting a relative shift length s between the first nozzle data ND1 and the second nozzle data ND2 by the data shift unit U12 from a shift length δ of the first nozzle row 68*a* and the second nozzle row 68*b* with respect to the reference. In this aspect, a ratio of the complementary dots DT1 and DT2 formed by the first complementary nozzle NZ1 and the second complementary nozzle NZ2 which have different positions from each other in the alignment direction D1 becomes a ratio obtained depending on the error length e obtained by subtracting the shift length s from the shift length δ. Therefore, it is possible to provide a more appropriate example in which the dot formed by the defective nozzle is complemented.

The recording apparatus 1 may further include a storage unit U4 (refer to FIG. 3) that stores distribution information (for example, distribution mask MA1 illustrated in FIG. 11) in which complementary dots DT1 and DT2 to be formed is formed at a ratio obtained depending on a distance between the defective nozzle LN and the first complementary nozzle NZ1 in the alignment direction D1. The processing unit U1 may cause complementary dots DT1 and DT2 to be formed by the first complementary nozzle NZ1 and the second complementary nozzle NZ2 in accordance with the distribution information (MA1). In this aspect, the complementary dots DT1 and DT2 are formed by the first complementary nozzle NZ1 and the second complementary nozzle NZ2 in accordance with the distribution information (MA1) stored in the storage unit U4. Therefore, it is possible to provide an appropriate example in which the dot formed by the defective nozzle is complemented.

Figure 14:
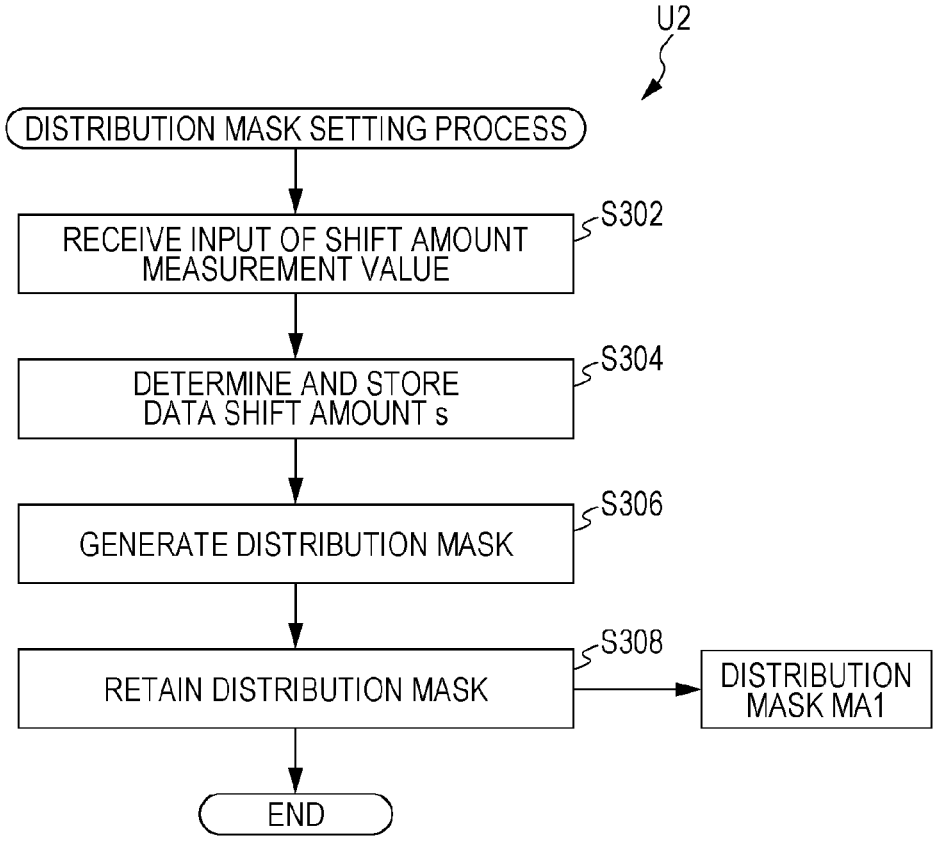
FIG. 14 is a flowchart illustrating an example of a distribution mask setting process.

As illustrated in FIG. 14, the recording apparatus may further include a shift length input unit U2 that inputs information indicating a shift length δ of the first nozzle row 68*a* and the second nozzle row 68*b* with respect to a reference. The processing unit U1 may set a ratio (Rm or Rs) of a complementary dot DT1 formed by the first complementary nozzle NZ1 with respect to complementary dots DT1 and DT2 formed by the first complementary nozzle NZ1 and the second complementary nozzle NZ2 to be a ratio obtained depending on a shift length δ indicated by the information input by the shift length input unit U2. In this aspect, although the shift length δ is changed by replacing a head 61 or the like, the information indication the shift length δ is input and thus, the ratio of complementary dots DT1 and DT2 formed by the first complementary nozzle NZ1 and the second complementary nozzle NZ2 which have different positions from each other in the alignment direction D1 becomes the ratio obtained depending on the shift length δ indicated by the information input by the shift length input unit U2. Hence, in this aspect, it is possible to improve convenience and, although the shift length δ is changed, it is possible to maintain accuracy of complementing the dot formed by the defective nozzle LN.

(2) SPECIFIC EXAMPLE OF RECORDING APPARATUS AND RECORDING METHOD

Hereinafter, a line printer in which a plurality of nozzles do not move but a recording substrate moves when a liquid droplet is discharged and a dot is formed will be described as a specific example.

Figure 2:
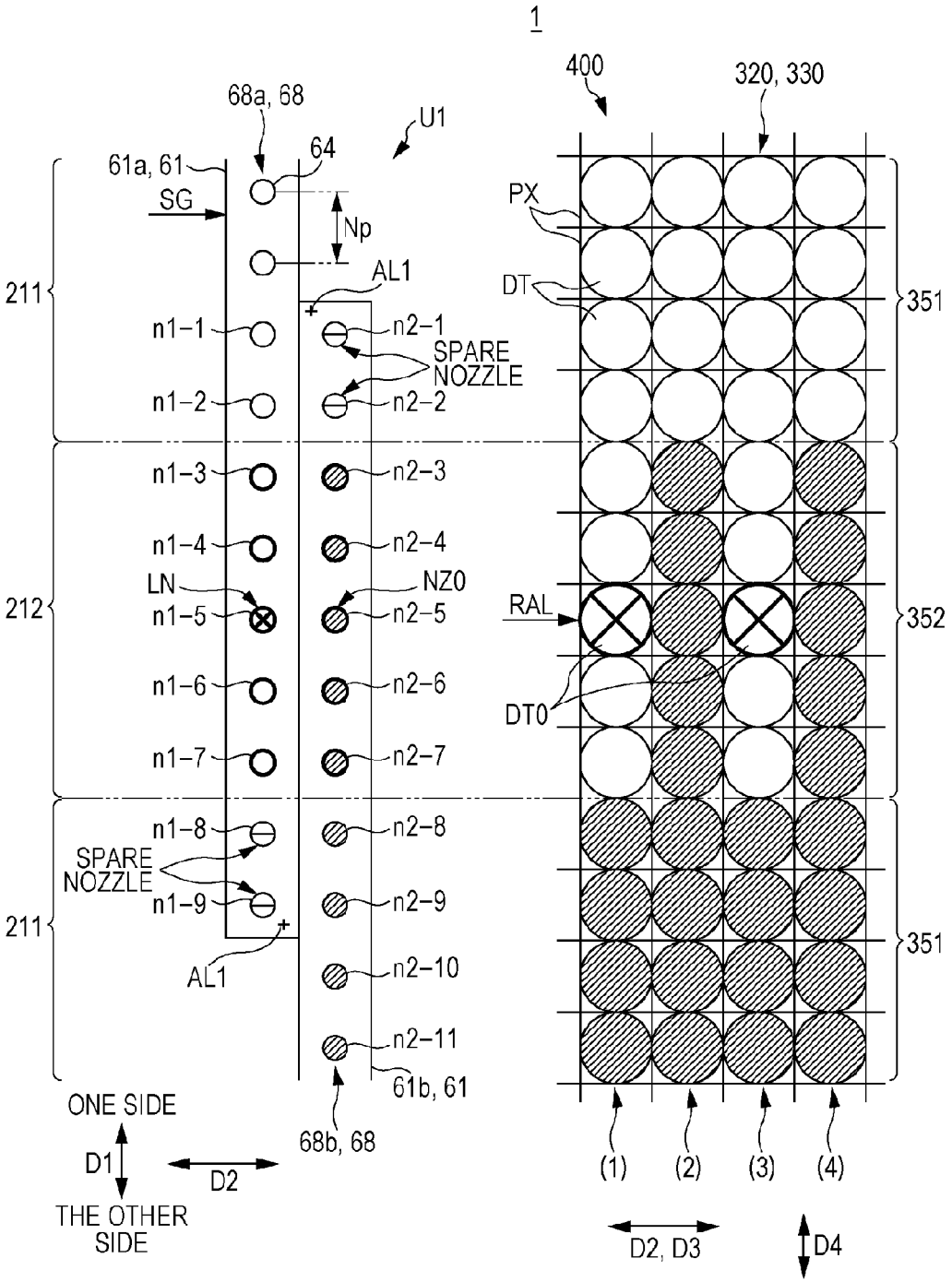
FIG. 2 is a view schematically illustrating an example of dot complementing when there is no shift between chips in the alignment direction.
Figure 3:
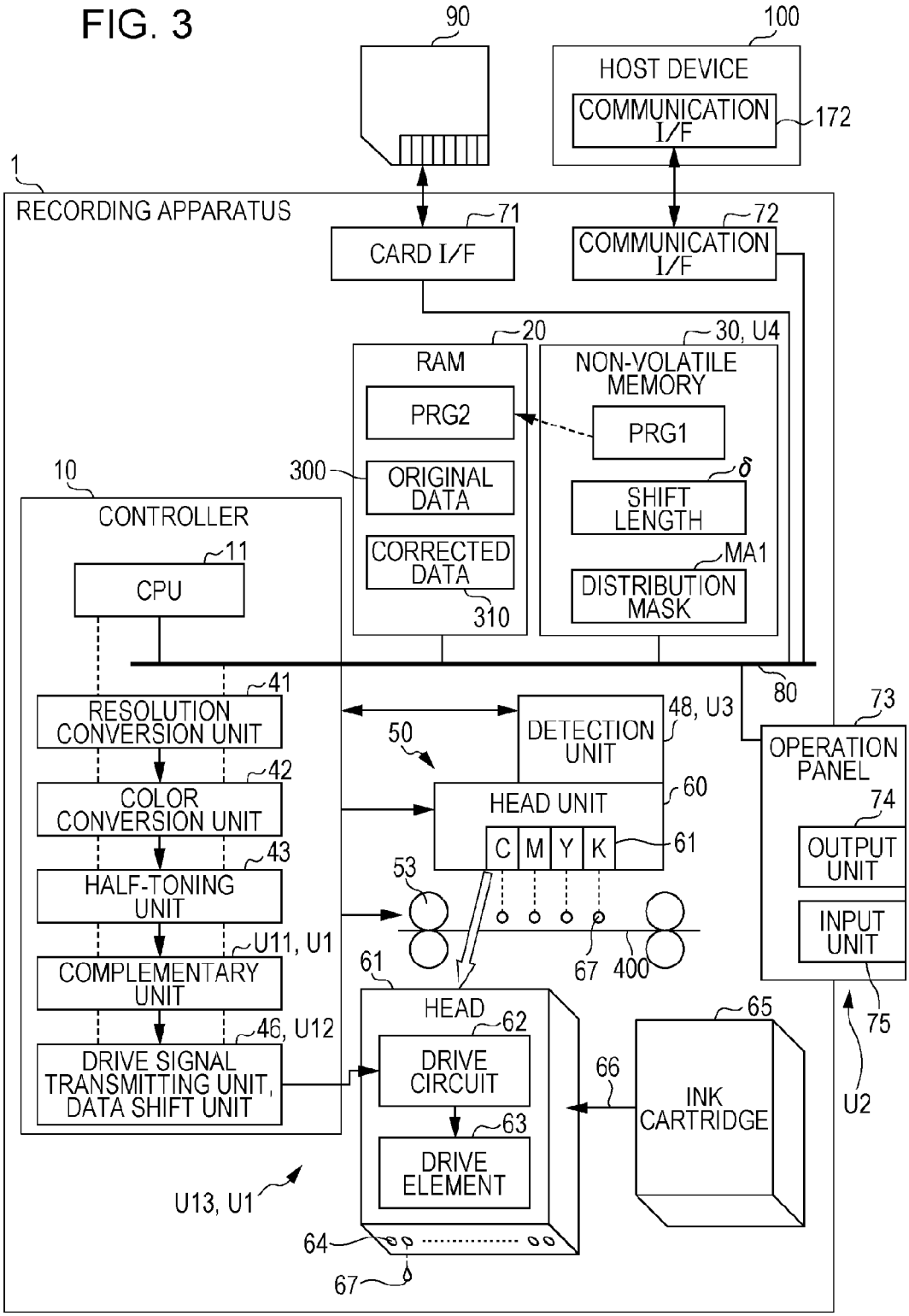
FIG. 3 is a diagram schematically illustrating a configuration example of a line printer as a recording apparatus.
Figure 4:
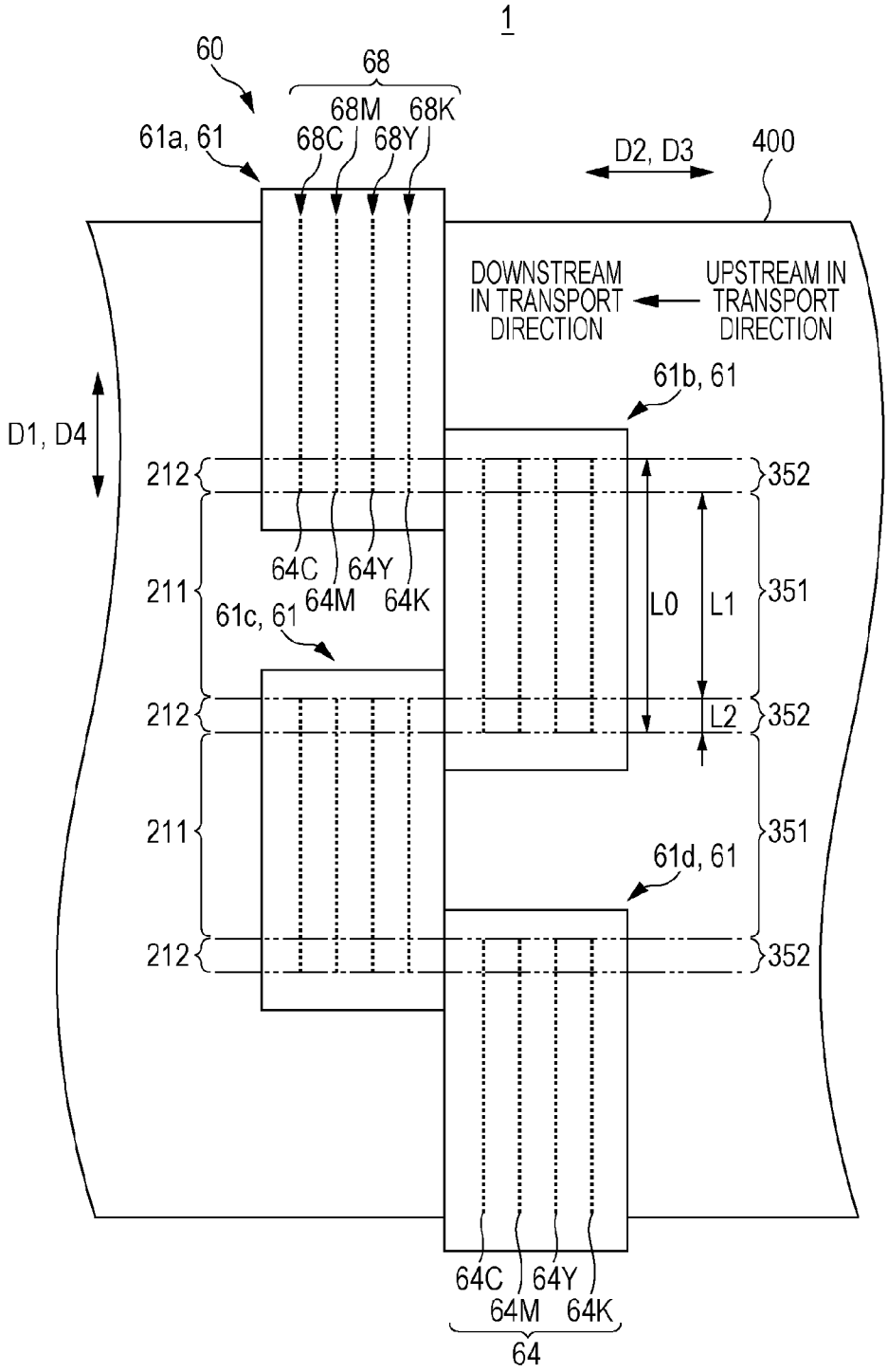
FIG. 4 is a view schematically illustrating main parts of the line printer as the recording apparatus.

FIG. 1 is a view schematically illustrating an example of dot complementing when there is a shift between chips in the alignment direction D1. FIG. 2 is a view schematically illustrating an example of dot complementing when there is no shift between chips in the alignment direction D1. FIG. 3 is a block diagram schematically illustrating a configuration example of a line printer as the recording apparatus 1. FIG. 4 is a view schematically illustrating main parts of the line printer as the recording apparatus 1. FIG. 5 is a diagram schematically illustrating a state in which the first nozzle data ND1 and the second nozzle data ND2 are relatively shifted.

In the specification, reference sign D1 represents an alignment direction of the nozzle 64, reference sign D3 represents a transport direction of the recording substrate 400 such as a print substrate, reference sign D2 represents a relative movement direction of the head 61 with the recording substrate 400, which is transported, as a reference, and reference sign D4 represents a width direction of the long recording substrate 400. As illustrated in FIG. 4, when the recording substrate 400 moves from the upstream side in the transport direction to the downstream side in the transport direction with respect to the fixed head 61, dots are formed in order from the downstream side in the transport direction to the upstream side in the transport direction with respect to the recording substrate 400. In the example in FIG. 1 or the like, although the alignment direction D1 matches the width direction D4, the alignment direction D1 and the width direction D4 may be shifted about 45° from each other, or the like. These directions D1 and D4 may be a different direction from the relative movement direction D2 (transport direction D3) and not only a case of being orthogonal to each other, but also a case of intersecting with each other not orthogonal to each other such as intersecting with each other at about 45° or the like is included in the invention. Needless to say, a case where two directions intersect with each other includes cases where two directions are shifted including a case of being orthogonal to each other. For easy understanding, an enlargement ratio is different in each direction and the drawings are not matched in some cases. In addition, dots illustrated in FIG. 1 are schematically illustrated only for description and a size, a shape, or the like of a dot to be formed in reality needs not to be matched with that in the drawing. The head 61 illustrated in FIGS. 1 to 4 is schematically illustrated only for description and a size, a shape, or the like of a head to be formed in reality needs not to be matched with that in the drawing. Further, a pixel PX illustrated in FIG. 2 indicates, for convenience, a landing position of the ink droplet (liquid droplet) 67 which is discharged (ejected) from the non-inclined head 61 according to calculation and, in a case where there is a shift between chips, the landing position of the ink droplet 67 is shifted from the position according to the calculation.

The print substrate is a material that holds a printed image. A common shape thereof is rectangular; however, circular (for example, an optical disk such as a CD-ROM or a DVD), triangular, quadrangular, polyangular, or the like and includes at least all of the types of paper and paperboard and processed products recorded in JIS (Japanese Industrial Standards) P0001:1998 (paper/paperboard and pulp terms). The print substrate includes a resin sheet, a metal plate, a three-dimensional object, or the like.

It is possible to allocate a color to a pixel individually and the pixel is the minimum element that configures an image.

The recording apparatus 1 generates corrected data 310 that displays a printed image 330 in which the dot formed by the defective nozzle LN is complemented based on original data 300 that displays a virtual image 320 that is not actually formed and on which dot complementing is not performed. The images 320 and 330 before and after complementing are multi-valued or binary images that display a state (including presence or absence) of forming a dot DT in each of pixels PX aligned in the relative movement direction D2 an in the width direction D4 according to calculation, respectively. The printed image 330 is an image which is actually formed on the recording substrate 400.

A head unit 60 illustrated in FIG. 4 includes the recording head 61 that has a nozzle row 68C of C, a nozzle row 68M of M, a nozzle row 68Y of Y, a nozzle row 68K of K. The head 61 may be provided for each color of CMYK. Each of the nozzle rows 68C, 68M, 68Y, and 68K is aligned in the transport direction D3 of the recording substrate. In the nozzle rows 68C, 68M, 68Y, and 68K, nozzles 64C, 64M, 64Y, and 64K are aligned in the alignment direction D1, respectively. In the head unit 60, a plurality of chips 61*a* to 61*d* are disposed such that it is possible to form the dot DT on the recording substrate 400 by the ink droplet 67 that is discharged from the nozzles 64C, 64M, 64Y, and 64K across all over the recording substrate 400 in the width direction D4. Here, the chips 61*a* to 61*d* are collectively referred to as the heads 61, the nozzle rows 68C, 68M, 68Y, and 68K are collectively referred to as the nozzle rows 68, and the nozzles 64C, 64M, 64Y, and 64K are collectively referred to as the nozzles 64.

The head unit 60 includes the plurality of nozzle rows 68 in which the plurality of nozzles 64 are aligned in the alignment direction D1 different from the relative movement direction D2. Here, the nozzle row 68 means any one of the nozzle rows of CMYK. In the meaning, as illustrated in FIG. 1, a part of the nozzles 64 of the first nozzle row 68*a* and the second nozzle row 68*b* included in the plurality of nozzle rows 68 are overlapped in the alignment direction D1. The recording substrate 400 moves in the transport direction D3 with respect to the plurality of nozzle rows 68, the ink droplet 67 is discharged from the nozzle 64 and thereby, the dot DT is formed.

In FIG. 4, a length of the nozzle row 68 in the alignment direction D1 is L0, a length of the overlap section 212, in the alignment direction D1, where positions of the nozzles 64 of the adjacent chips to each other are overlapped in the alignment direction D1 is L2, and a length of a solo section 211, in the alignment direction D1, where the positions of the nozzles 64 of the adjacent chips to each other are not overlapped in the alignment direction D1 is L1. The length L0 of the nozzle rows become L1+2×L2. On the recording substrate 400, there are formed an overlap region 352 in which dots are formed by the nozzles of the adjacent chips to each other and a solo region 351 in which dots are formed by the nozzles of one of the adjacent chips.

A nozzle row in which nozzles are disposed in a zigzag shape is included in the technology because a plurality of nozzles are aligned, for example, in two rows in the predetermined alignment direction different from the relative movement direction. In this case, the alignment direction means a direction of alignment of the nozzles in zigzag positions of each row.

In addition, when the chips 61*a* and 61*b* are taken as an example as illustrated in FIG. 2, an example is described, in which the printed image 330 is formed on the recording substrate 400 by the head 61 in which a part of the nozzles of the nozzle rows 68*a* and 68*b* included in the chips 61*a* and 61*b* are overlapped in the alignment direction D1. Here, the chip 61*a* that has the defective nozzle LN is called a noticed chip and the chip 61*b* that is adjacent to the noticed chip 61*a* is called an adjacent chip. The nozzles 64 in the adjacent chip 61*b* from one end in the alignment direction are identified by n2-1, n2-2, or the like and the nozzles on the noticed chip side at the same position in the alignment direction D1 are identified by n1-1, n1-2, or the like when there is no shift between the chips 61*a* and 61*b*. Nozzles n2-1, n2-2, n1-9, and n1-8 are backup nozzles and are not used when there is no shift between the chips 61*a* and 61*b*. Nozzles n1-3 to n1-7 and n2-3 to n2-7 are nozzles present in the overlap section 212. Nozzles n2-8 and n2-9 and nozzles n1-1 and n1-2 are nozzles present in the solo section 211. Each of the dots DT appearing on the virtual image 320 and the printed image 330 has the same shape as the nozzles that forms the dots. In the recording substrate 400, the dots DT are formed in the order of (1) to (4) in accordance with the movement of the recording substrate 400 in the transport direction D3.

The nozzles in the solo section 211 form all dots of a raster by one nozzle in the relative movement direction D2. In the technology, the raster mean a region which is continuous in a line shape in the relative movement direction. The dots of the solo region 351 on one side in the alignment direction from the overlap region 352 are formed by ink droplets discharged from nozzles of the noticed chip 61*a*. For example, the nozzle n1-1 of the noticed chip 61*a* forms all dots of the corresponding raster. The dots of the solo region 351 on the other side in the alignment direction from the overlap region 352 are formed by ink droplets discharged from nozzles of the adjacent chip 61*b*. For example, the nozzle n2-8 of the adjacent chip 61*b* forms all dots of the corresponding raster. The dots in the overlap region 352 are formed by nozzles of both the chips 61*a* and 61*b*. For example, in the raster in which dots are formed by the nozzles n1-3 and n2-3, dots are formed by the nozzle n1-3 of the noticed chip 61*a* in the odd number-th pixels PX (1) and (3) and dots are formed by the nozzle n2-3 of the adjacent chip 61*b* in the even number—the pixels PX (2) and (4). The same is true of the nozzles n1-4 to n1-7 and n2-4 to n2-7.

In the nozzle row 68, the defective nozzle LN through which the ink droplet is not discharged due to clogging or the like or the discharged ink droplet does not draw a correct trajectory is present in some cases. In a case where a defective nozzle n1-5 in the noticed chip 61*a* is present in the overlap section 212, in one pixel, for example, in FIG. 2, a dot is not formed in the odd number-th pixel. In a case where a dot DT0 that is supposed to be formed by the defective nozzle n1-5 is not complemented, a steak of thin unevenness is produced on the printed image 330 in the relative movement direction D2. When there is no shift between the chips 61*a* and 61*b*, it is possible to form a dot in the odd number-th pixel by the nozzle n2-5 (complementary nozzle NZ0) that forms dots in the same raster RAL as the defective nozzle n1-5.

Actually, when the chips 61*a* to 61*d* are assembled, a shift is produced at a relative position between the adjacent chips to each other in the alignment direction D1 in some cases. FIG. 1 illustrates an example in which, with the adjacent chip 61*b* as the reference, the noticed chip 61*a* is shifted 0.7 times the nozzle pitch Np to one side in the alignment direction. When the shift length δ is described with the shift as much as the nozzle pitch Np as 1, FIG. 1 illustrates an example of δ=0.7. As illustrated in FIG. 1, the position of the defective nozzle n1-5 in the alignment direction D1 does not match neither position of the nozzle n2-4 nor n2-5 of the adjacent chip 61*b*. In this case, as illustrated in FIG. 15, even when the complementary dot DT9 is formed only by the complementary nozzle NZ9 closest to the defective nozzle LN in positions in the alignment direction, a streak of unevenness 800 is produced on the printed image 930 in the relative movement direction D2 in some cases. This is because the programmed position of forming the dot by the defective nozzle LN in the alignment direction D1 and the position of forming of the dot DT9 by complementary nozzle NZ9 are shifted.

In the technology, as illustrated in FIG. 1, since the complementary dots DT1 and Dt2 are formed by the complementary nozzles NZ1 and NZ2 closest to the defective nozzle LN on one side in the alignment direction and on the other side in the alignment direction in positions in the alignment direction D1, the streak of unevenness described above is prevented. The more details are described below.

The recording apparatus 1 illustrated in FIG. 3 includes a controller 10, a random access memory (RAM) 20, a non-volatile memory 30, a defective nozzle detection unit 48, a mechanism unit 50, interfaces (I/F) 71 and 72, an operation panel 73, or the like. The controller 10, the RAM 20, the non-volatile memory 30, I/Fs 71 and 72, and the operation panel 73 are connected by a bus 80 and information can be input and output from each other.

The controller 10 includes a central processing unit (CPU) 11, a resolution conversion unit 41, a color conversion unit 42, a half-toning unit 43, an complementary unit U11, a drive signal transmitting unit 46, or the like. The drive signal transmitting unit 46 configures a data shift unit U12 causes a shift of the first nozzle row 68*a* and the second nozzle row 68*b* in the alignment direction D1 to become smaller in data with respect to a reference. The controller 10 configures a dot forming unit U13 along with the mechanism unit 50 and configures a defective nozzle detecting unit U3 along with the detection unit 48. The controller 10 can be configured by a system on chip (SoC) or the like.

The CPU 11 is a device that mainly performs an information process or control in the recording apparatus 1.

The resolution conversion unit 41 converts resolution of an input image from a host device 100 or a memory card 90 into setting resolution (for example, 600 dpi in the width direction D4 and 1200 dpi in the relative movement direction D2). The input image is displayed by, for example, RGB data that has an integer value of 256 levels of RGB (red, green, and blue) for each pixel.

The color conversion unit 42 convers RGB data of the setting resolution into CMYK data that has the inter value of 256 levels of CMYK for each pixel.

The half-toning unit 43 performs for example, a predetermined half-toning process such as a dither method, an error diffusion method, and a density pattern method, with respect to a level value of each pixel that configures the CMYK data, reduces the number of levels of the level value, and generates half-toning data. The half-toning data is data indicating a state of forming a dot, may be binary data that represents forming or not forming a dot, may be multi-valued data of 3 or more levels which can correspond to different sizes of dots such as big, medium, and small dots. The binary data which can be expressed by one bit for each pixel can be, for example, data in which, for example, 1 represents dot formation and 0 represents no dot. Four-valued data which can be expressed by 2 bits for each pixel can be data corresponding to, for example, 3 represents a large dot formation, 2 represents a medium dot formation, 1 represents a small dot formation, and 0 represents no dot. In a case where the large dot is dedicated to the complementary dot, the half-toning data may be multi-valued data in which a large dot is not formed. The half-toning data is original data 300 before the dot formed by the defective nozzle LN is corrected in the embodiment.

The complementary unit U11 generates the corrected data 310 by which complementary dots DT1 and DT2 which complement the dot formed by the defective nozzle LN in the original data 300. Hence, the corrected data 310 is also data that represents a dot forming state and may be binary data, and may be multi-valued data. In the corrected data 310, the nozzle data ND1 and ND2 which forms dots by the nozzle rows 68*a* and 68*b*. The details of the complementary unit U11 will be described below.

The drive signal transmitting unit 46 generates a drive signal SG corresponding to a voltage signal applied to a drive element 63 of the head 61, from the corrected data 310, and outputs the drive signal to a drive circuit 62. For example, a drive signal that causes the ink droplet for the large dot to be discharged is output when the corrected data 310 is "large dot formation", a drive signal that causes the ink droplet for the medium dot to be discharged is output when the corrected data 310 is "medium dot formation", and a drive signal that causes the ink droplet for the small dot to be discharged is output, when the corrected data 310 is "small dot formation". In addition, the drive signal transmitting unit 46 (data shift unit U12) relatively shifts the nozzle data ND1 and ND2 to nozzle rows 68*a* and 68*b* at a nozzle unit such that the nozzles correspond to each other between the chips so as to become closest to each other in positions in the alignment direction D1 in the overlap section 212 in a case where the shift between the chips becomes a certain extent or more.

The each unit 41, 42, 43, U11, and 46 may be configured by an application specific integrated circuit (ASIC) and data which is a processing target is directly read from the RAM 20 or the data after the processing may be directly read from the RAM 20.

FIG. 5 is schematically illustrates a data shift process performed by the data shift unit U12. On the left side of FIG. 5, the nozzle data ND1 and ND2 which is used for drive signal generation in a case where there is no shift between chips 61*a* and 61*b*. These data items are data before data shifting in a case of performing the data shift process. Here, nozzle data d1-1, d1-2, or the like (first nozzle data ND1) is assigned to the nozzles n1-1, n1-2, or the like of the noticed chip 61*a* and nozzle data d2-3, d2-4, or the like (second nozzle data ND2) is assigned to the nozzles n2-3, n2-4, or the like of the adjacent chip 61*b*. No nozzle data is assigned to the backup nozzles n1-8, n1-9, n2-1, and n2-2. The first nozzle data d1-1, d1-2, or the like and the second nozzle data d2-3, d2-4, or the like becomes data or the like that is expressed by, for example, 1 and 0 when the data is binary data, and becomes data or the like which is expressed by, for example, 3, 2, 1, 0 when the data is four-valued data.

For example, as illustrated in FIG. 1, the noticed chip 61*a* is shifted 0.7 times the nozzle pitch Np to one side in the alignment direction with respect to the adjacent chip 61*b*. In this case, the nozzle closest to the defective nozzle n1-5 of the nozzles of the adjacent chip 61*b* in positions in the alignment direction D1 does not become the closest nozzle n2-5 when there is no shift between the chips but the nozzle n2-4 closer to one side from the nozzle n2-5 in the alignment direction. The nozzles n1-4 to n1-8 of the noticed chip 61*a* are caused to correspond to the nozzles n2-3 to n2-7 of the adjacent chip 61*b* in the overlap section 212, respectively, and the nozzles used in the first nozzle row 68*a* that is in the noticed chip 61*a* are displaced to the other side one by one in the alignment direction. The nozzle n1-8 is a backup nozzle and is not used when there is no shift between the chips. In order to displace the nozzle used in the noticed chip 61*a* one by one to the other side in the alignment direction, there is a need to displace the first nozzle data ND1, which is used in a case where there is no shift between the chips, by an amount of one nozzle to the other side in the alignment direction. In this case, as illustrated in FIG. 5, the data shift unit U12 causes the nozzle data d1-1 to d1-7 which corresponds to the nozzles n1-1 to n1-7 before the data shift to be displaced by an amount of one nozzle to the other side in the alignment direction and to correspond to the nozzles n1-2 to n1-8 after the data shift. On the right side of FIG. 5, for easy understanding, the positions of the nozzles corresponding to the first nozzle data ND1 in the noticed chip 61*a* are displaced to one side in the alignment direction by amount of one nozzle. In this manner, the relative shift of the nozzle rows 68*a* and 68*b* becomes smaller in the data.

Since the relative shift is produced between the chips 61*a* and 61*b*, the noticed chip 61*a* is shifted by, for example, 0.7×Np to one side in the alignment direction with respect to the adjacent chip 61*b*, which means that the adjacent chip 61*b* is shifted by, for example, 0.7×Np to the other side in the alignment direction with respect to the noticed chip 61*b*. The data shift unit U12 may cause the nozzle data d2-3 to d2-11 which corresponds to the nozzles n2-3 to n2-11 before the data shift to be displaced to one side by the amount of one nozzle in the alignment direction and to correspond to the nozzles n2-2 to n2-10 after the data shift.

The mechanism unit 50 illustrated in FIG. 3 includes a paper feeding mechanism 53, the head unit 60, the head 61, and the like and configures the dot forming unit U13 together with the controller 10. The paper feeding mechanism 53 transports, in the transport direction D3, the recording substrate 400 which is continuous in the relative movement direction D2. The head 61 that discharges, for example, ink droplets 67 of CMYK is mounted on the head unit 60. The head 61 includes the drive circuit 62, the drive element 63, and the like. The drive circuit 62 applies the voltage signal to the drive element 63 in accordance with the drive signal SG which is input from the controller 10. As the drive element 63, it is possible to use a piezoelectric element that applies a voltage to ink (liquid) 66 in a pressure chamber which communicates with the nozzle or a piezoelectric element that causes bubbles to be produced by in the pressure chamber by heat and causes the ink droplet 67 to be discharged from the nozzle 64. The ink 66 is supplied to the pressure chamber of theh61 from an ink cartridge 65 (liquid cartridge). Combination of the ink cartridge 65 with the head 61 is provided, for example, for each of CMYK. The ink 66 in the pressure chamber is discharged as the ink droplet 67 from the nozzle 64 by the drive element 63 toward the recording substrate 400 such as a printing sheet and the dot DT of the ink droplet 67 is formed on the recording substrate 400. The recording substrate 400 is transported in the transport direction D3, that is, the plurality of nozzles 64 and the recording substrate 400 relatively move in the relative movement direction D2, and thereby, the printed image 330 corresponding to the corrected data 310 is formed by the plurality of dots DT. When the multi-valued data is four-value data, the image 330 is printed by forming dots according to the dot size which is indicated in the multi-valued data.

The RAM 20 is a volatile semiconductor memory with large capacity and stores a program PRG2, the original data 300, the corrected data 310, or the like. The program PRG2 includes a recording program that causes the recording apparatus 1 to execute processing functions corresponding to the units U1 to U3 of the recording apparatus 1, respectively, a shift length input function, and a defective nozzle detection function.

Program data PRG1, the shift length δ between the chips, distribution mask (distribution information) MA1, and the like are stored in the non-volatile memory 30 (storage unit U4). The shift length δ between the chips is a shift length of the first nozzle row 68*a* and the second nozzle row 68*b* with respect to a relatively designed position (reference) and can be obtained by, for example, measuring a distance between alignment marks AL1 in the alignment direction D1, which are provided to the chips 61*a* and 61*b* and calculating a difference from the designed value. The distribution mask MA1 is an information table which is used such that the complementary dots DT1 and DT2 formed by the complementary nozzles NZ1 and NZ2 have the ratio depending on a distance (for example, in FIG. 9A, "1−e") between the defective nozzle LN and the first complementary nozzle NZ1 in the alignment direction D1. Since the distance (for example, in FIG. 9A, "e") between the defective nozzle LN and the second complementary nozzle NZ2 depends on the distance between the defective nozzle LN and the first complementary nozzle NZ1, the distribution mask MA1 is referred to as the information table by which the complementary dots DT1 and DT2 are formed at a ratio obtained depending on the distance between the defective nozzle LN and the second complementary nozzle NZ2 in the alignment direction D1.

For example, when staff in a manufacturing plant of the recording apparatus measures the shift length δ between the chips, it is possible to store the shift length δ and the distribution mask MA1 according to the shift length δ in the non-volatile memory 30. Needless to say, a user of the recording apparatus measures the shift length δ and may perform work so as to store the shift length δ and the distribution mask MA1 according to shift length δ in the non-volatile memory 30. As the non-volatile memory 30, a magnetic recording medium such as the read only memory (ROM) or the hard disk, or the like is used. That the program data PRG1 is executed means that the program is written on the RAM 20 as a program that can be interpreted in CPU 11.

The card I/F 71 is a circuit that writes data to the memory card 90 or read the data from the memory card 90. The memory card 90 is a non-volatile semiconductor memory on which data can be written and can be removed from and an image captured by an imaging apparatus such as a digital camera, or the like is stored. The image is, for example, represented by a pixel value in an RGB color space and each pixel value of the RGB is represented by the level value of 8 bits of 0 to 255.

The communication I/F 72 is connected to a communication I/F 172 of the host device 100 and inputs and outputs data to and from the host device 100. A Universal Serial Bus (USB), or the like is used in the communication I/Fs 72 and 172. The host device 100 includes a computer such as a personal computer, a digital camera, a digital video camera, a mobile phone such as a smart phone, or the like.

The operation panel 73 includes an output section 74, an input section 75, or the like, and a user can input various instructions to the recording apparatus 1 through the operation panel. The output section 74 is configured of, for example, a liquid crystal panel (display section) on which information according to various instructions or information representing a state of the recording apparatus is displayed. The output section 74 may perform audio output of the information items. The input section 75 is configured to, for example, have a cursor key or an operation key (operation input section) such as a determination key. The input section 75 may a touch panel or the like which receives an operation on a display screen. The operation panel 73 can become the shift length input unit U2 that inputs the information representing the shift length δ with respect to the reference in the alignment direction D1 of the nozzle row 68.

The defective nozzle detection unit 48 configures the defective nozzle detecting unit U3 which, with the controller 10, detects that the states of the nozzles 64 are normal or are defective.

Figure 6A:
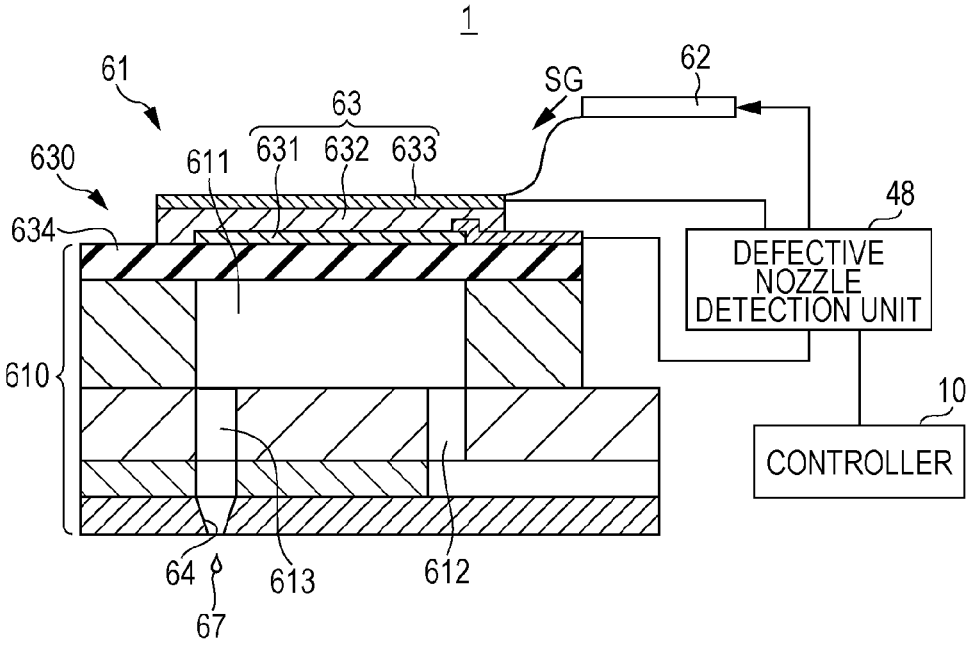
FIG. 6A is a diagram schematically illustrating main parts of the recording apparatus and FIG. 6B is a diagram schematically illustrating an electromotive force curve based on residual vibration of a vibration plate.
Figure 6B:
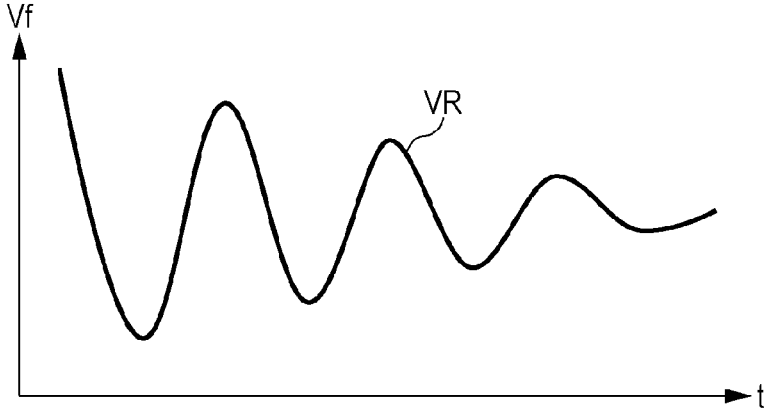
Figure 7A:
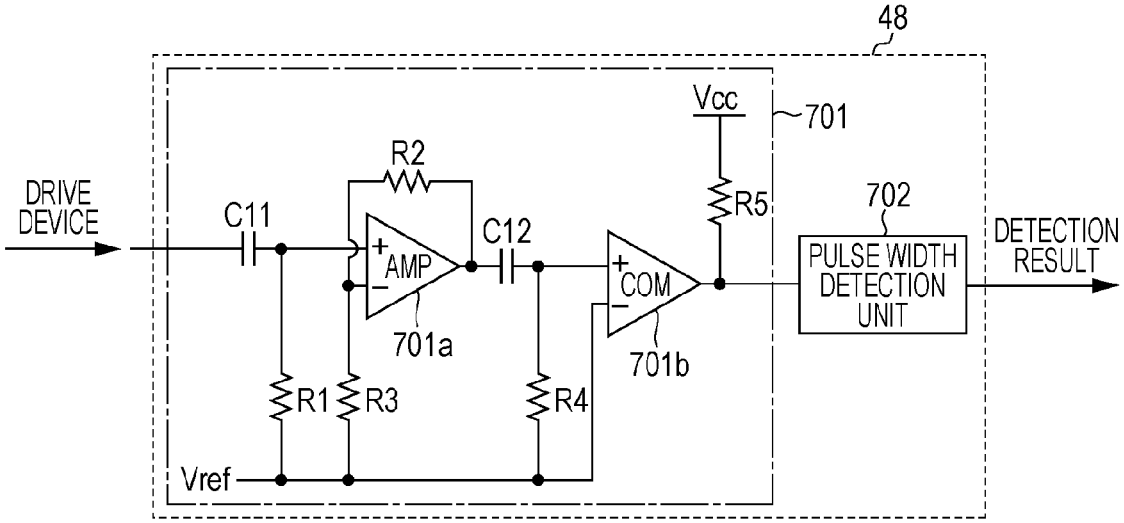
FIG. 7A is a diagram illustrating an example of an electrical circuit of a defective nozzle detection unit and FIG. 7B is a view schematically illustrating an example of an output signal from an amplification unit.
Figure 7B:
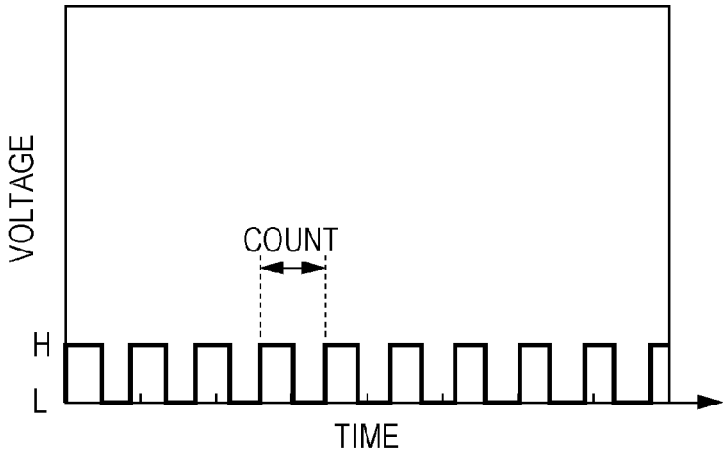

FIGS. 6A and 6B are diagrams illustrating an example of a method of detecting the state of the nozzle 64. FIG. 6A is a diagram schematically illustrating main parts of the recording apparatus 1 and FIG. 6B is a diagram schematically illustrating an electromotive force curve VR based on residual vibration of a vibration plate 630. FIG. 7A illustrates an example of an electrical circuit of the detection unit 48 and FIG. 7B schematically illustrates an example of an output signal from a comparator 701*b*.

In a flow path substrate 610 of the head 61 illustrated in FIG. 6A, a pressure chamber 611, an ink supply path 612 through which the ink 66 flows from the ink cartridge 65 to the pressure chamber 611, a nozzle communicating path 613 through which the ink 66 flows from the pressure chamber 611 to the nozzle 64, or the like. For example, it is possible to use a silicon substrate or the like as the flow path substrate 610. The surface of the flow path substrate 610 is formed of a vibration plate section 634 that configures a part of a wall surface of the pressure chamber 611. The vibration plate section 634 can be configured of, for example, silicon oxide. The vibration plate 630 can be configured to include, for example, vibration plate section 634, the drive element 63 formed on the vibration plate section 634, or the like. The drive element 63 can be a piezoelectric element which includes, for example, a lower electrode 631 formed on the vibration plate section 634, a piezoelectric layer 632 formed substantially on the lower electrode 631, an upper electrode 633 formed substantially on the piezoelectric layer 632. It is possible to form the electrodes 631 and 633 using, for example, platinum or gold. It is possible to form the piezoelectric layer 632 using a ferroelectric perovskite oxide such as lead zirconate titanate (PZT, stoichiometric proportion $Pb(Zr_x,Ti_{1-x})O_3$).

FIG. 6A illustrates a block diagram of main parts of the recording apparatus 1 which is provided with the detection unit 48 that detects a electromotive force state from the piezoelectric element (drive element 63) based on the residual vibration of the vibration plate 630. One end of the detection unit 48 is electrically connected to the lower electrode 631 and the other end of the detection unit 48 is electrically connected to the upper electrode 633.

FIG. 6B is illustrates the electromotive force curve (electromotive force state) VR of the drive element 63 based on the residual vibration of the vibration plate 630 which is produced after supply of the drive signal SG for causing the ink droplet 67 to be discharged from the nozzle 64. Here, the horizontal axis is time t and the vertical axis is electromotive force Vf. The electromotive force curve VR shows an example in which the ink droplet 67 is normally discharged from the nozzle 64. When the ink droplet 67 is not discharged due to clogging or the like or the discharged ink droplet 67 does not draw a correct trajectory, the electromotive force curve is shifted from the VR. As illustrated in FIG. 7A, it is possible to detect that the nozzle 64 is normal or defective using the detection circuit.

The detection unit 48 illustrated in FIG. 7A includes an amplification unit 701 and a pulse width detecting unit 702. The amplification unit 701 includes, for example, an operational amplifier 701*a*, the comparator 701*b*, capacitors C11 and C12, and resistors R1 to R5. When the drive signal SG output from the drive circuit 62 is applied to the drive element 63, the residual vibration is produced and the electromotive force based on the residual vibration is input to the amplification unit 701. A low frequency component contained in the electromotive force is removed by a high-pass filter which is configured to have the capacitor C11 and the resistor R1 and the electromotive force after removing the low frequency component is amplified at a predetermined amplification rate by the operational amplifier 701*a*. An output of the operational amplifier 701*a* passes through a high-pass filter which is configured to have the capacitor C12 and the resistor R4, is compared to a reference voltage Vref by the comparator 701*b*, and is converted into a pulsing voltage of a high level or a low level depending on whether or not the output is higher than the reference voltage Vref.

FIG. 7B is illustrates an example of the pulsing voltage which is output from the comparator 701*b* and is input to the pulse width detecting unit 702. The pulse width detecting unit 702 resets a count value when the input pulsing voltage is rounded off, the count value is incremented for each predetermined period, and the count value is output to the controller 10 as a detection result when the next pulsing voltage is rounded off. The count value corresponds to a cycle of the electromotive force based on the residual vibration and the sequentially output count values represent frequency characteristics of the electromotive force based on the residual vibration. The frequency characteristics (for example, cycle) of the electromotive force in a case where a nozzle is the defective nozzle LN is different from frequency characteristics of the electromotive force in a case where nozzles are normal. The controller 10 can determine that a detection target nozzle is normal when the sequentially input count values are within an allowable range and can determine that a detection target nozzle is the defective nozzle LN when the sequentially input count values are out of an allowable range.

The controller 10 performs the processes described above for each nozzle 64, thereby can gather a state of the nozzles 64, and can store information representing a position of the defective nozzle LN, for example, in the RAM 20 or in the non-volatile memory 30.

Needless to say, the detection of the defective nozzle LN is not limited to the method described above. For example, the ink droplet 67 is ejected while a target nozzle is sequentially switched from the plurality of nozzles 64 and operation input of information (for example, nozzle number) is received, by which a nozzle that does not form a dot on the recording substrate 400 is identified. This method is included in the detection of the defective nozzle LN. In addition, when information by which the defective nozzle LN is identified is caused to be stored, for example, in the non-volatile memory 30 before the product is shipped from a manufacturing plant, there is no need to provide the defective nozzle detecting unit U3 in the recording apparatus 1.

Next, a flow of nozzle data correction in the complementary nozzles NZ1 and NZ2 will be described with reference to FIG. 8. Here, again, the description is provided with the chips 61*a* and 61*b* as an example.

First, the shift length δ of the chips 61*a* and 61*b*, that is, the shift length δ between the first nozzle row 68*a* of the noticed chip and the second nozzle row 68*b* of the adjacent chip with respect to the relative designed position (reference) is acquired (Step S102, hereinafter, "Step" is omitted). As described above, it is possible to obtain the shift length δ by measuring a distance between the alignment marks AL1 in the alignment direction D1, which are provided to the chips 61*a* and 61*b* and by calculating a difference between the distance and the designed value. For convenience of description, on the premise that an orientation of the shift is grasped, $\delta \geq 0$.

In the next S104, a data shift length s is determined. The shift length s needs to relatively shift the nozzle data ND1 and ND2 such that positions of nozzles between the nozzle rows 68*a* and 68*b* in the overlap section 212 in the alignment direction D1. It is possible to obtain the shift length s by, for example, rounding the shift length δ off to the nearest number, rounding the shift length δ off or down to the nearest integer.

In the next S106, a rounded error length e obtained by performing rounding off the shift length δ or the like is determined. The error length e can be, for example, a value obtained by subtracting the shift length s from the shift length δ.

In the next S108, the first complementary nozzle NZ1 that is closest to the defective nozzle LN on one side in the alignment direction and the second complementary nozzle NZ2 that is closest to the defective nozzle LN on the other side in the alignment direction in the positions in the second nozzle row 68*b* in the alignment direction D1 are identified. Of the complementary nozzles NZ1 and NZ2, one side closer to the defective nozzle LN is identified as the main complementary nozzle NZm and the other side far from the defective nozzle LN is identified as sub main complementary nozzle NZs in positions in the alignment direction D1. The distribution ratio Rm to the main complementary nozzle NZm and the distribution ratio Rs to the sub complementary nozzle NZs are determined.

Figure 9A:
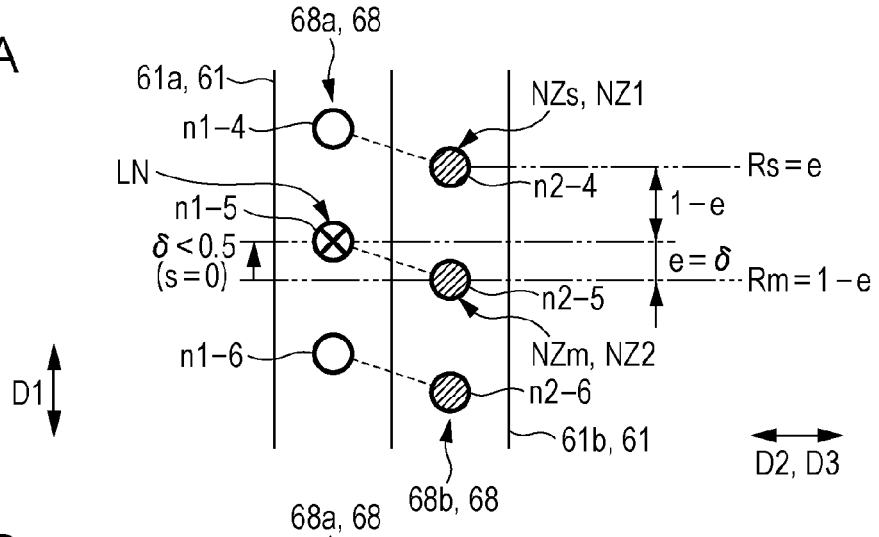
FIGS. 9A to 9C are views illustrating positional relationships of nozzles depending on shift lengths.
Figure 9B:
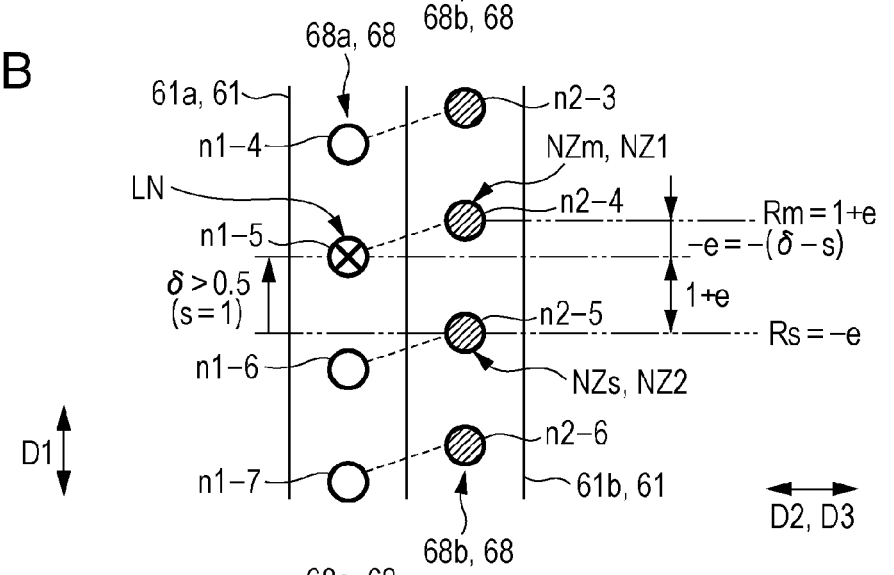
Figure 9C:
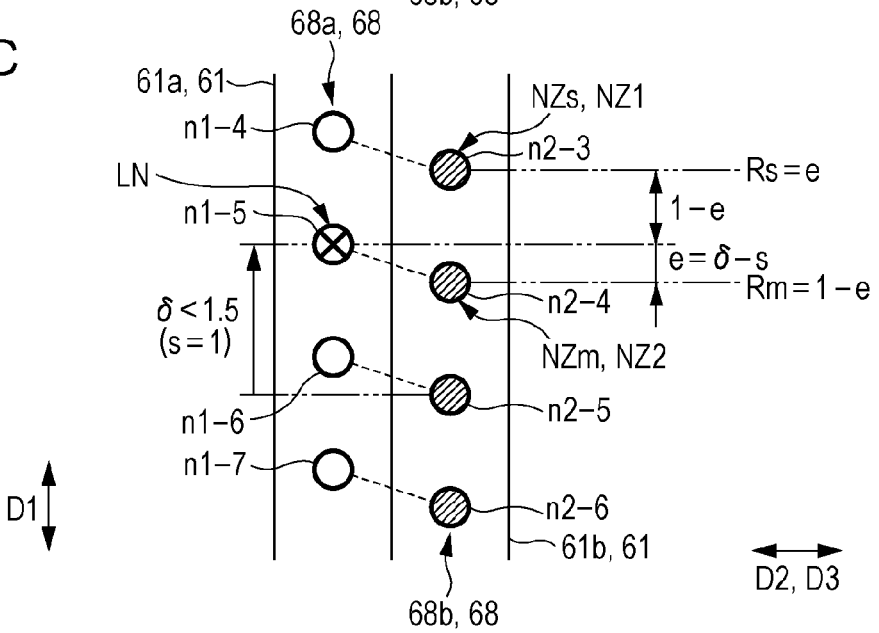
Figure 10A:
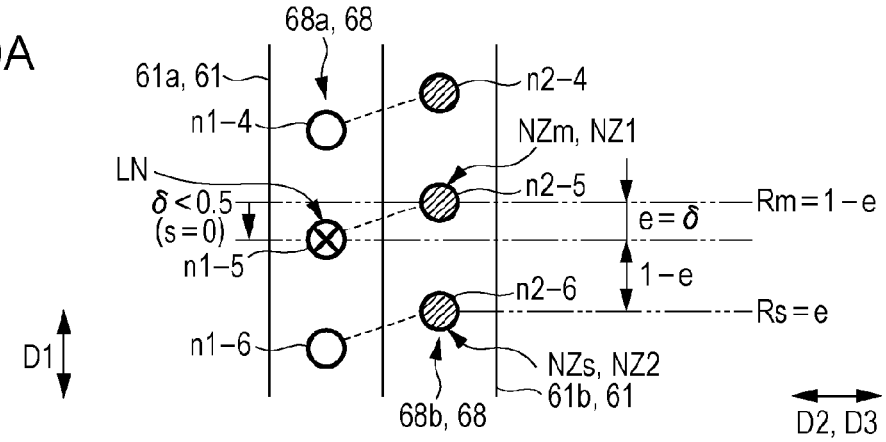
FIGS. 10A to 10C are views illustrating positional relationships of the nozzles depending on the shift lengths.
Figure 10B:
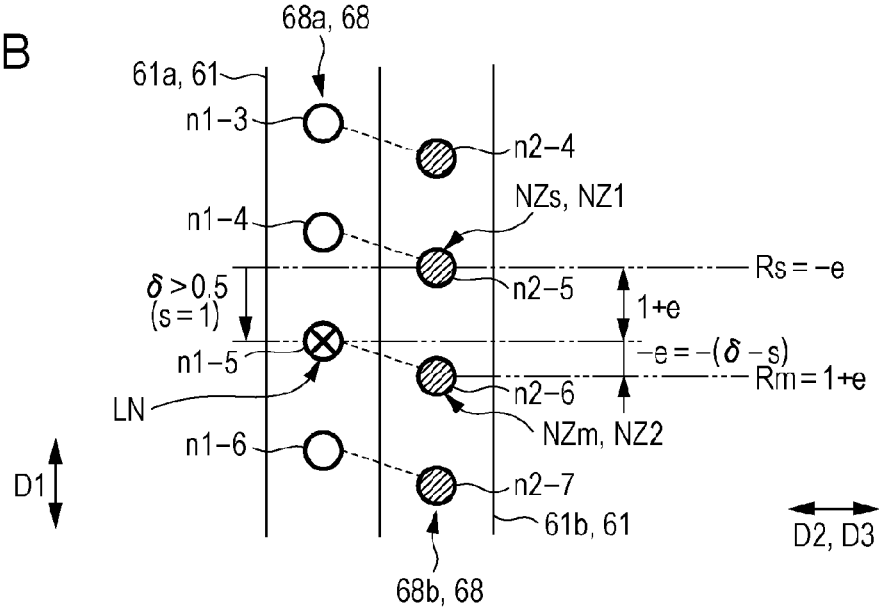
Figure 10C:
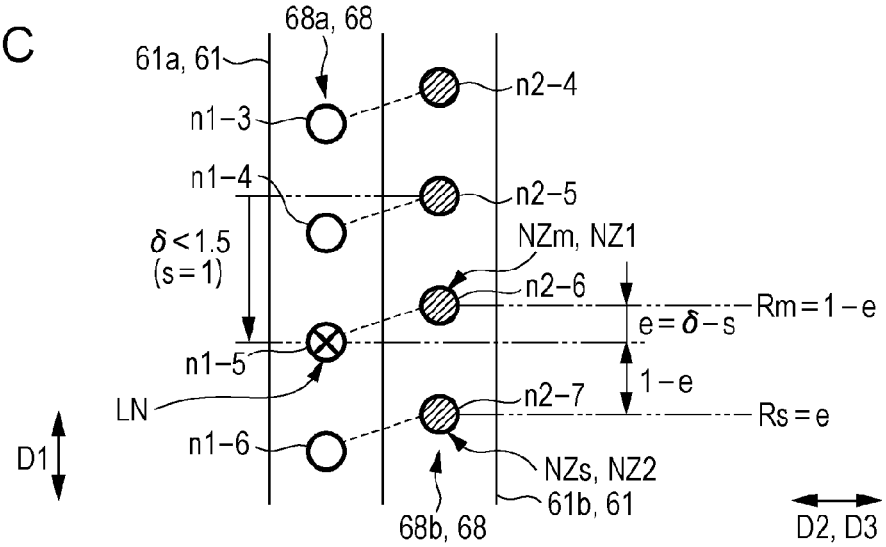

FIGS. 9A to 9C and FIGS. 10A to 10C illustrate the shift length δ, the shift length s, the error length e, and the distribution ratio Rm or Rs with respect to various shifts between the nozzle rows 68*a* and 68*b*. Each of nozzles of the nozzle rows 68*a* and 68*b* are distinguished by reference signs illustrated in FIGS. 1 and 2. The nozzles closest to each other in positions between the nozzle rows 68*a* and 68*b* in the alignment direction D1 are connected to each other in a dashed line. In addition, FIGS. 9A to 9C illustrate an example in which the first nozzle row 68*a* is shifted with respect to the second nozzle row 68*b* on one side (upper side in the drawing) in the alignment direction and FIGS. 10A to 10C illustrate an example in which the first nozzle row 68*a* is shifted with respect to the second nozzle row 68*b* on the other side (lower side in the drawing) in the alignment direction. In the description below, when a distance is mentioned, it means the distance in the alignment direction D1.

In the example illustrated in FIG. 9A, $\delta<0.5$, the shift length s becomes 0 as a rounded value of the shift length δ, and the error length e becomes δ. In this case, since a distance 1−e between the first complementary nozzle n2-4 and the defective nozzle n1-5 is greater than a distance e between the second complementary nozzle n2-5 and the defective nozzle n1-5, the second complementary nozzle n2-5 becomes the main complementary nozzle NZm and the first complementary nozzle n2-4 becomes the sub complementary nozzle NZs. When the distribution ratio Rm or Rs formed by the complementary nozzles NZm and NZs is in inverse proportion to the distance from the defective nozzle n1-5, the distribution ratio Rm to the main complementary nozzle NZm becomes 1−e and the distribution ratio Rs to the sub complementary nozzle NZs becomes e.

In the example illustrated in FIG. 9B, $0.5<\delta<1$, the shift length s becomes 1 as a rounded value of the shift length δ, and the error length e becomes δ−s (minus value). In this case, since the distance −e=−(δ−s) between the first complementary nozzle n2-4 and the defective nozzle n1-5 is smaller than the distance 1+e between the second complementary nozzle n2-5 and the defective nozzle n1-5, the first complementary nozzle n2-4 becomes the main complementary nozzle NZm and the second complementary nozzle n2-5 becomes the sub complementary nozzle NZs. In a case where the distribution ratio is in an inverse proportion to the distance from the defective nozzle, the distribution ratio Rm to the main complementary nozzle NZm becomes 1+e and the distribution ratio Rs to the sub complementary nozzle NZs becomes −e.

In the example illustrated in FIG. 9C, $1<\delta<1.5$, the shift length s becomes 1 as a rounded value of the shift length δ, and the error length e becomes δ−s (plus value). In this case, since the first complementary nozzle NZ1 is changed to the nozzle n2-3, distance 1−e between the first complementary nozzle n2-3 and the defective nozzle n1-5 is greater than a distance e=δ−s between the second complementary nozzle n2-4 and the defective nozzle n1-5, the second complementary nozzle n2-4 becomes the main complementary nozzle NZm and the first complementary nozzle n2-3 becomes the sub complementary nozzle NZs. In a case where the distribution ratio is in an inverse proportion to the distance from the defective nozzle, the distribution ratio Rm to the main complementary nozzle NZm becomes 1−e and the distribution ratio Rs to the sub complementary nozzle NZs becomes e.

The examples illustrated in FIGS. 10A to 10C are the same as the examples illustrated in FIGS. 9A to 9C except that the orientation of the shift is different and thus, it is possible to determine the distribution ratio Rm or Rs in the same method.

Figure 8:
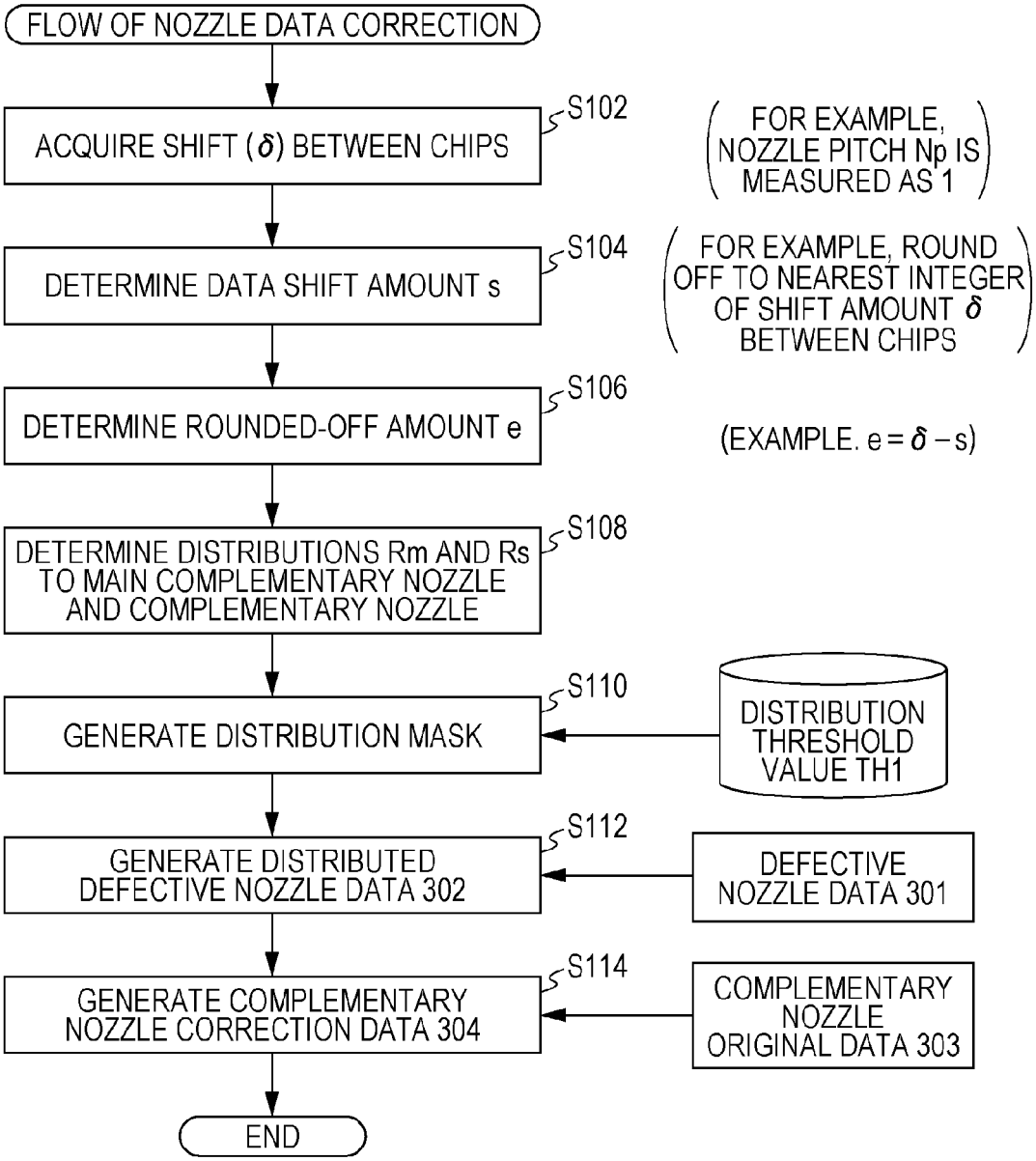
FIG. 8 is a diagram illustrating a flow of nozzle data correction.

In S110 in FIG. 8, the distribution mask MA1 is generated using the distribution threshold value TH1.

Figure 11:
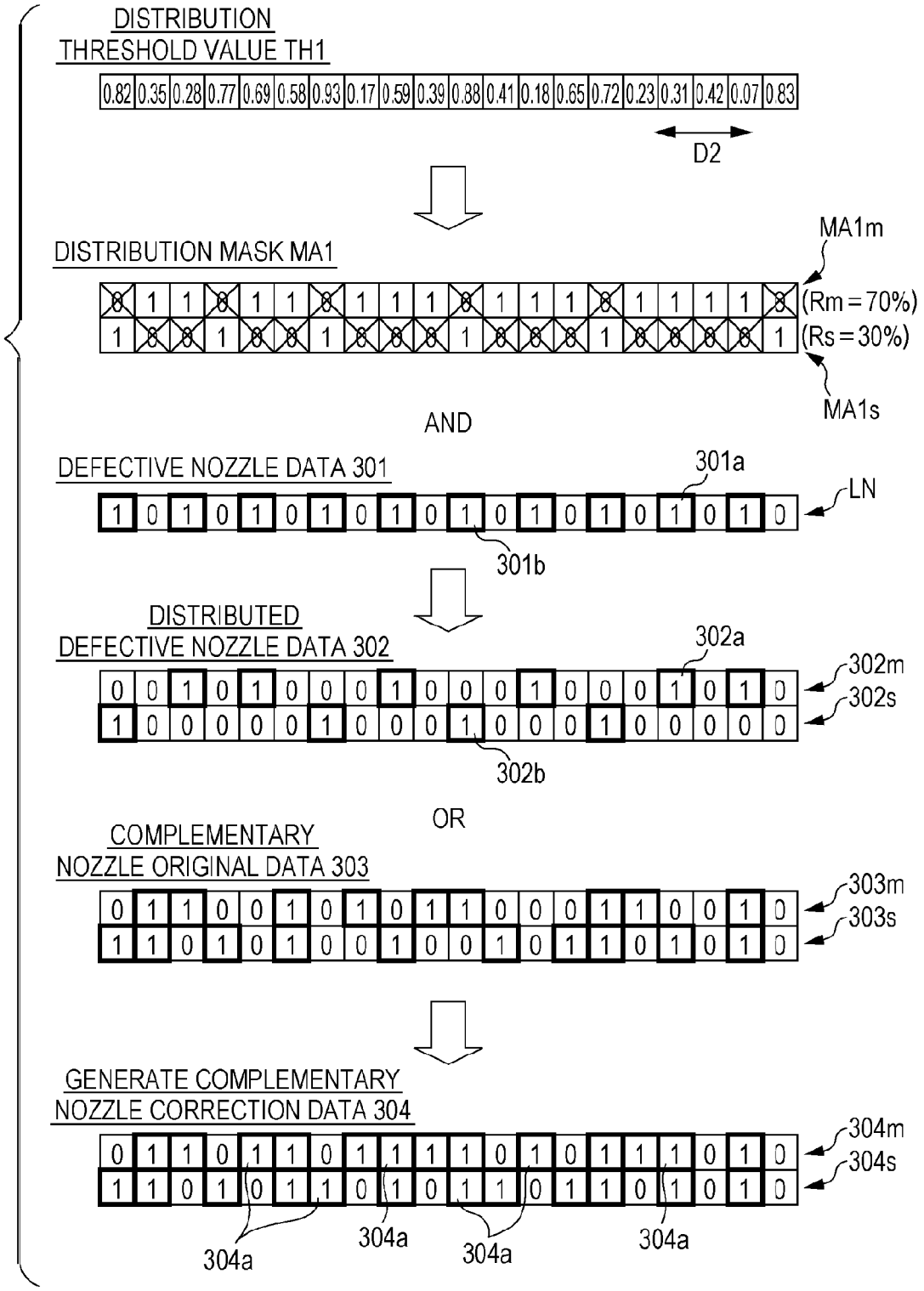
FIG. 11 is a diagram schematically illustrating a state of generating complementary nozzle correcting data.

FIG. 11 schematically illustrates an example of generating the distribution mask MA1 from the distribution threshold value TH1 and the distribution ratio Rm. The distribution threshold value TH1 is provided for each pixel of the pixel row continuous in the relative movement direction D2 and, for example, becomes a value of 0 to 1. In a case where the distribution ratio Rm to the main complementary nozzle NZm is represented by a value of 0 to 1, data which causes the complementary dot to be formed by the sub complementary nozzle NZs is disposed at a pixel row MA1*s* for the sub complementary nozzle of the distribution mask MA1 when the distribution threshold value TH1 is equal to or greater than Rm and data which causes the complementary dot to be formed by the main complementary nozzle NZm is disposed at a pixel row MA1*m* for the main complementary nozzle of the distribution mask MA1 when the distribution threshold value TH1 is less than Rm. Otherwise, data which causes the complementary dot to be formed by the main complementary nozzle NZm may be disposed at the pixel row MA1*m* for the main complementary nozzle of the distribution mask MA1 when the distribution threshold value TH1 is equal to or greater than the distribution ratio Rs to the sub complementary nozzle NZs and data which causes the complementary dot to be formed by the sub complementary nozzle NZs may be disposed at the pixel row MA1*s* for the sub complementary nozzle of the distribution mask MA1 when the distribution threshold value TH1 is less than Rs. In the distribution mask MA1 illustrated in FIG. 11, 1 is retained in the pixel on which the complementary dot can be formed and 0 is retained in the pixel on which the complementary dot is not formed. For easy understanding, mark x is added to the pixel in which 0 is retained.

In S112 in FIG. 8, defective nozzle data 301 assigned to the defective nozzle LN is distributed to data for the main complementary nozzle and data for the sub complementary nozzle and then distributed defective nozzle data 302 is generated. The defective nozzle data 301 is nozzle data for a defective nozzle which is contained in the original data 300 before the dot formed by the defective nozzle LN is complemented. In FIG. 11, for easy understanding, the defective nozzle data 301 in which 1 (forming a dot) or 0 (not forming a dot) is retained in each pixel is illustrated and the pixel in which 1 is retained is enclosed in a heavy line. For example, it is possible for AND in the pixels of the pixel row MA1*m* for the main complementary nozzle of the distribution mask MA1 and the defective nozzle data 301 to be retained in a pixel row 302*m* for the main complementary nozzle of the distributed defective nozzle data 302 and for AND of the pixel row MA1*s* for the sub complementary nozzle of the distribution mask MA1 and the defective nozzle data 301 to be retained in a pixel row 302*s* for the sub complementary nozzle of the distributed defective nozzle data 302. FIG. 11 shows that data "1" of a pixel 301*a* included in the defective nozzle data 301 is disposed in the pixel row 302*m* for the main complementary nozzle in accordance with the distribution mask MA1 and data "1" of a pixel 301*b* included in the defective nozzle data 301 is disposed in the pixel row 302*s* for the sub complementary nozzle in accordance with the distribution mask MA1. The pixel in which 1 is retained is enclosed in a heavy line also in the distributed defective nozzle data 302.

In S114 in FIG. 8, original complementary nozzle data 303 assigned to the complementary nozzles NZm and NZs is corrected in accordance with the distributed defective nozzle data 302 described above and complementary nozzle correcting data 304 is generated. The original complementary nozzle data 303 is nozzle data for the complementary nozzles NZm and NZs included in the original data 300 before the dot formed by the defective nozzle LN is complemented. In the original complementary nozzle data 303 also illustrated in FIG. 11, 1 (forming a dot) or 0 (not forming a dot) is retained in each pixel and the pixel in which 1 is retained is enclosed in a heavy line. In some cases, the data with which a dot is formed is retained in the pixel of the original complementary nozzle data 303 corresponding to the pixel in which a dot is formed in the distributed defective nozzle data 302. For example, OR in the pixels of the pixel row 302*m* for the main complementary nozzle of the distributed defective nozzle data 302 and the pixel row 303*m* for the main complementary nozzle of the original complementary nozzle data 303 is retained in the pixel row 304*m* for the main complementary nozzle of the complementary nozzle correcting data 304 and OR in the pixels of the pixel row 302*s* for the sub complementary nozzle of the distributed defective nozzle data 302 and the pixel row 303*s* for the sub complementary nozzle of the original complementary nozzle data 303 is retained in the pixel row 304*s* for the sub complementary nozzle of the complementary nozzle correcting data 304. FIG. 11 illustrates that the data "1" of the pixel 302*a* included in the distributed defective nozzle data 302 is retained in the pixel row 304*m* for the main complementary nozzle of the complementary nozzle correcting data 304 and the data "1" of the pixel 302*b* included in the distributed defective nozzle data 302 is retained in the pixel row 304*s* for the sub complementary nozzle of the complementary nozzle correcting data 304. The pixel in which 1 is retained is enclosed in a heavy line also in the complementary nozzle correcting data 304. A pixel 304*a* included in the complementary nozzle correcting data 304 is a pixel in which a dot is not formed by the original complementary nozzle data 303 but a new complementary dot is formed.

The data 301 to 304 may be multi-valued data such as four-valued data. For example, in a case where the data 301 to 304 is the four-valued data, in S112, the defective nozzle data 301 of 0 to 3 may be distributed to the data for the main complementary nozzle and the data for the sub complementary nozzle in accordance with the distribution mask MA1 and the distributed defective nozzle data 302 may be generated. In S114, the distributed defective nozzle data 302 of 0 to 3 and the original complementary nozzle data 303 of 0 to 3 may be added in a range of 3 or less in each pixel and the complementary nozzle correcting data 304 may be generated.

Figure 12A:
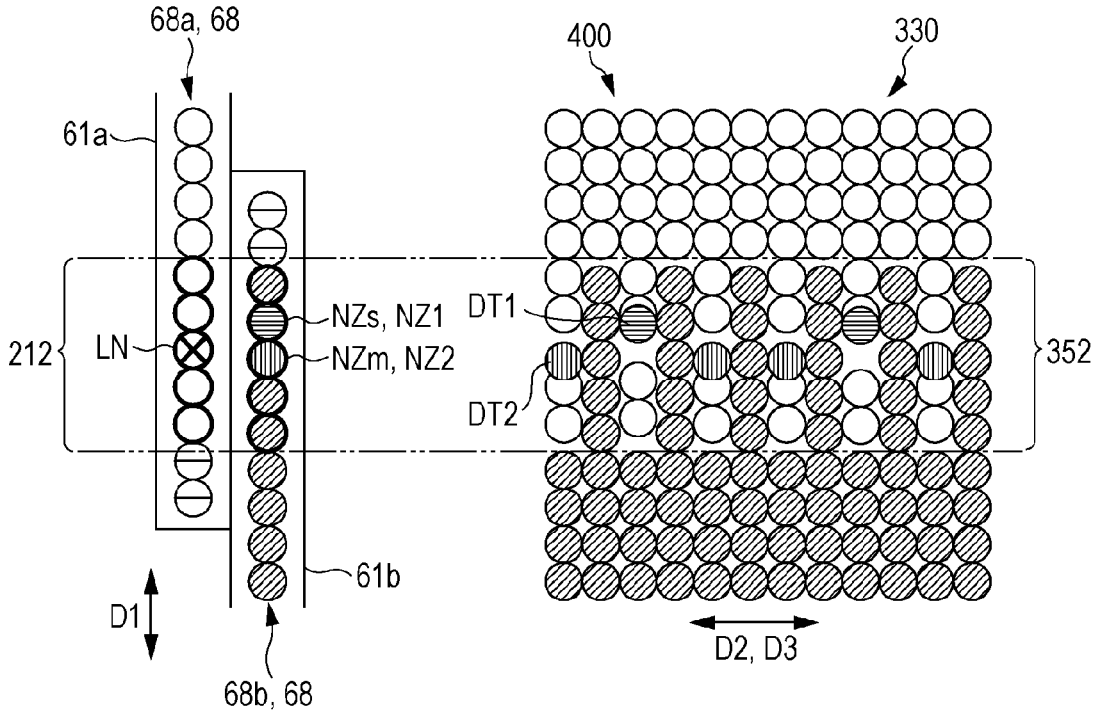
FIGS. 12A and 12B are view schematically illustrating examples of printed images that include complementary dots.
Figure 12B:
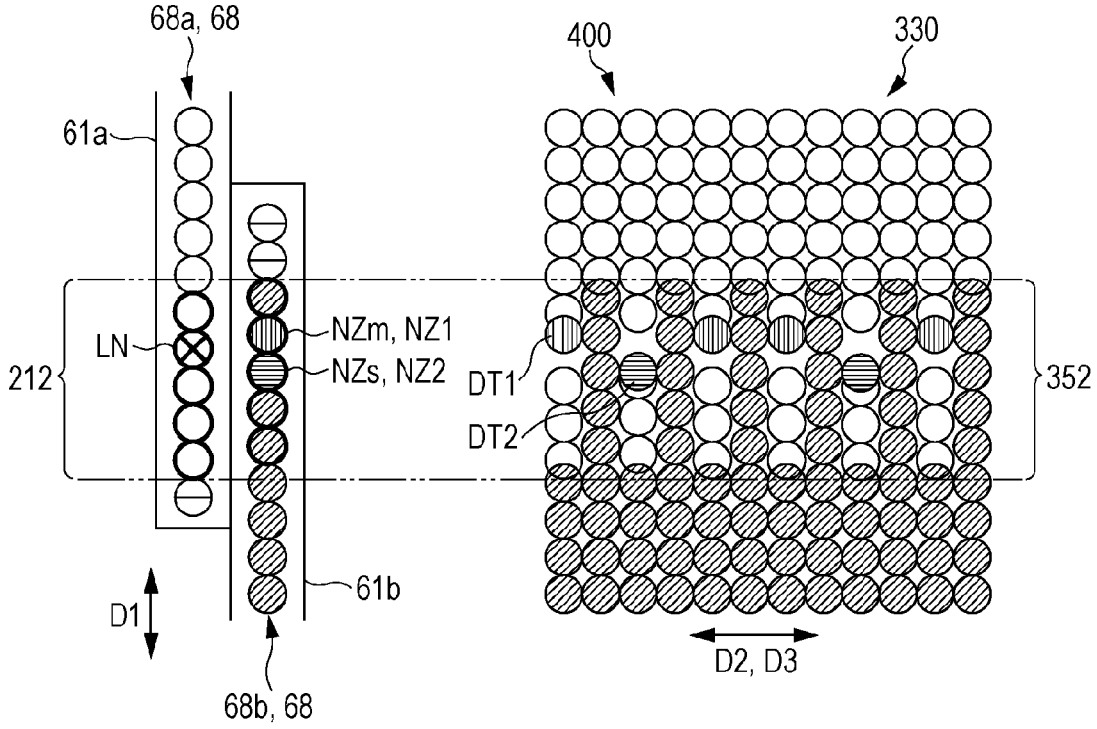

FIGS. 12A and 12B schematically illustrate examples of printed images 330 that are formed along the flow described above. FIG. 12A illustrates a case where, as illustrated in FIG. 9A, the first nozzle row 68*a* is relatively shifted to one side with respect to the second nozzle row 68*b* in the alignment direction, the shift length δ is less than 0.5, the shift length s becomes 0, and the second complementary nozzle NZ2 is the main complementary nozzle NZm. In this case, the complementary dots DT1 and DT2 are formed by the complementary nozzles NZ1 and NZ2 and the dots DT2 by the main complementary nozzle NZm are formed more than the dots DT1 by the sub complementary nozzle NZs. The complementary dots DT1 and DT2 which have different positions in the alignment direction D1 are formed and thereby, the thin streak of unevenness 800 is prevented in one pixel as illustrated in FIG. 15. In addition, the forming ratio of complementary dots DT2 by the main complementary nozzle NZm closer to the defective nozzle LN in positions in the alignment direction D1 is high and thereby, the dot which is supposed to be formed by the defective nozzle LN is appropriately complemented.

FIG. 12B illustrates a case where, as illustrated in FIG. 9B, the first nozzle row 68*a* is relatively shifted to one side with respect to the second nozzle row 68*b* in the alignment direction, the shift length δ is greater than 0.5 and less than 1, the shift length s becomes 1, and the first complementary nozzle NZ1 is the main complementary nozzle NZm. In this case, the complementary dots DT1 and DT2 are formed by the complementary nozzles NZ1 and NZ2 and the dots DT1 by the main complementary nozzle NZm are formed more than the dots DT2 by the sub complementary nozzle NZs. In this case, also the thin streak of unevenness 800 is prevented in one pixel as illustrated in FIG. 15 and the forming ratio of complementary dots DT1 by the main complementary nozzle NZm closer to the defective nozzle LN in positions in the alignment direction D1 is high and thereby, the dot which is supposed to be formed by the defective nozzle LN is appropriately complemented.

Figure 13:
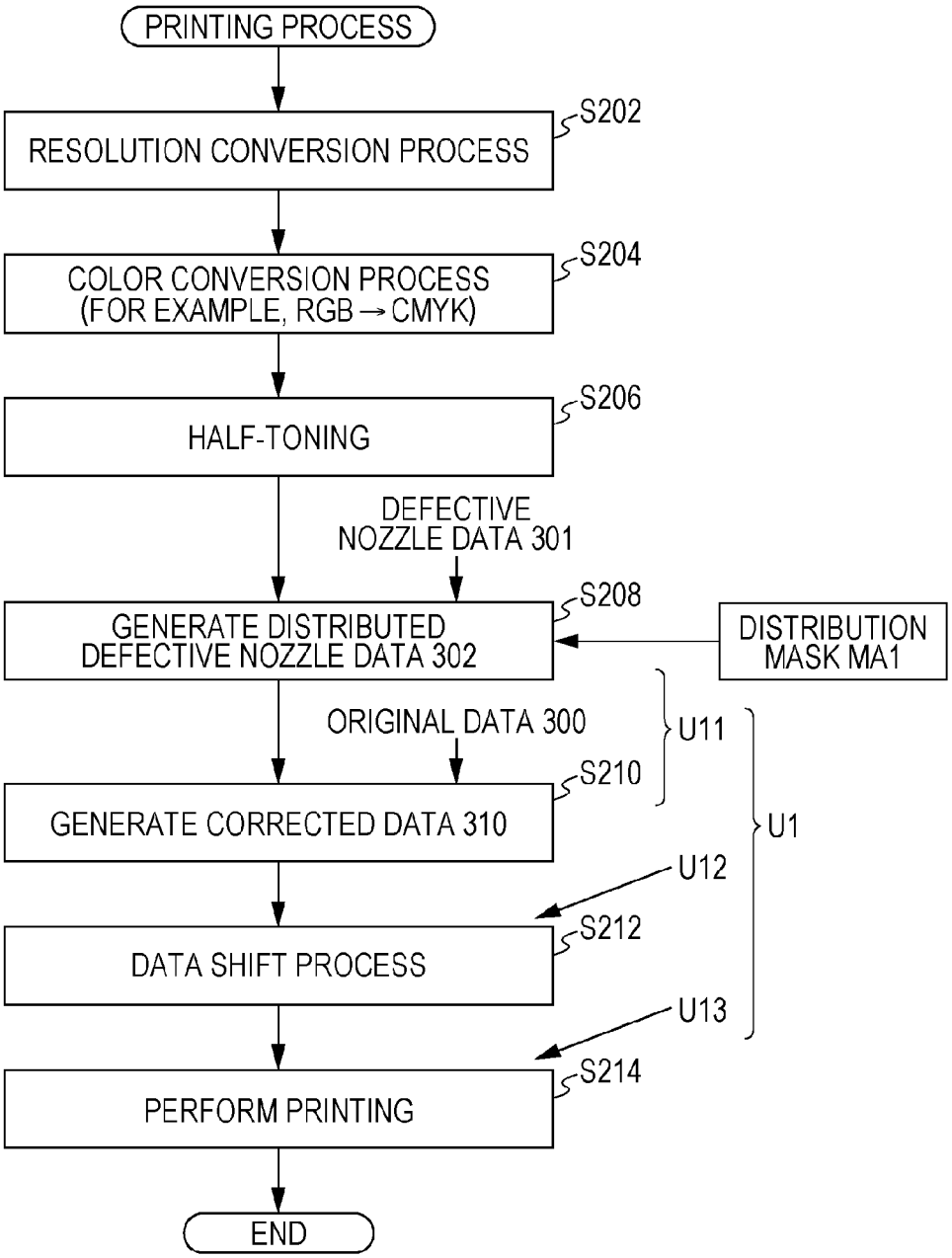
FIG. 13 is a flowchart illustrating an example of a printing process.

The distribution mask MA1 described above is stored in the recording apparatus 1 (for example, non-volatile memory 30 illustrated in FIG. 3) and thereby, it is possible for the dot to be rapidly complemented in accordance with the distribution mask MA1. An example of printing process performed in the recording apparatus 1 is described with reference to FIG. 13 or the like. In FIG. 13, the processes between S202 to S214 in which the printed image 330 is formed based on an input image from the host device 100, the memory card 90, or the like, are performed in the order by the units 41, 42, 43, U11, 46, and 50 described above. The printing process may be realized by the electric circuit or may be realized by a program. Here, the controller 10 and the mechanism unit 50 which perform the processes between S208 to S214 configure the processing unit U1, the controller 10 which performs the processes between S208 to S210 configures the complementary unit U11, the drive signal transmitting unit 46 (controller 10) which performs the process of S212 configures the data shift unit U12, and the controller 10 and the mechanism unit 50 which perform the process of S214 configure the dot forming unit U13.

When the printing process is started, the resolution conversion unit 41 converts the RGB data (for example, 256 levels) representing the input image into the setting resolution (for example, 600×1200 dpi) (S202). The color conversion unit 42 converts colors of the RGB data of the setting resolution into the CMYK data (for example, 256 levels) (S204). The half-toning unit 43 performs a half-toning process to the CMYK data and generates half-toning data (S206). This half-toning data is original data 300 representing the virtual image 320 in which the dot is not formed by the defective nozzle LN.

After the original data 300 is generated, the complementary unit U11, first, distributes the defective nozzle data 301 included in the original data 300 into the data for the main complementary nozzle and the data for the sub complementary nozzle and generates the distributed defective nozzle data 302 (S208). The example of forming the distributed defective nozzle data 302 is as illustrated in FIG. 11. Next, the complementary unit U11 corrects the original complementary nozzle data 303 included in the original data 300 in accordance with the distributed defective nozzle data 302 and generates the corrected data 310 including the complementary nozzle correcting data 304 (S210). The example of forming the complementary nozzle correcting data 304 is as illustrated in FIG. 11. The complementary dots DT1 and DT2 which have different positions in the alignment direction D1 are formed according to the complementary nozzle correcting data 304 and in accordance with the data "1" retained in the pixel 304*a*. The data obtained by removing the original complementary nozzle data 303 and the defective nozzle data 301 from the original data 300 is used in the corrected data 310. Since the dot is not formed by the defective nozzle LN, the defective nozzle data 301 may be used in the corrected data 310.

After the corrected data 310 is generated, the drive signal transmitting unit 46 causes the nozzle data ND1 and ND2, with which the dots are formed by the nozzle rows 68*a* and 68*b* as illustrated in FIG. 5 when the data shift length s obtained from the shift length δ is not 0, to be relatively shifted at a nozzle unit in the alignment direction D1 (S212). The nozzle data ND1 and ND2 is shifted in accordance with the shift length s and thereby, the shift of the nozzle rows 68*a* and 68*b* in the alignment direction D1 becomes smaller in the data with respect to the designed position. In addition, the complementary dots DT1 and DT2 are formed from the first complementary nozzle NZ1 closest to the defective nozzle LN on one side in the alignment direction and from the second complementary nozzle NZ2 closest to the defective nozzle LN on the other side in the alignment direction in positions in the alignment direction D1.

Next, the drive signal transmitting unit 46 generates the drive signal SG corresponding to the corrected data 310, outputs the signal to the drive circuit 62 of the head 61, causes the drive element 63 to drive in accordance with the corrected data 310, causes the ink droplet 67 to be discharged from the nozzle 64 of the head 61, and performs printing (S214). Accordingly, the printed image 330 formed of the multi-valued dots (for example, binary or four-valued) including the complementary dots DT1 and DT2 on the recording substrate 400 and the printing process ends. In a case where a dot is not formed by the original data 300 but a new dot is formed, this new dot becomes the complementary dot and in a case where a dot is formed by the original data 300 and a dot size is large, the large-sized dot becomes the complementary dot.

Through the above processes, as illustrated in FIG. 1 and FIGS. 12A an 12B, the complementary dot DT1 is formed from the first complementary nozzle NZ1 on the one side from the defective nozzle LN in the alignment direction in positions in the alignment direction D1 and the complementary dot DT2 is formed from the second complementary nozzle NZ2 on the other side from the defective nozzle LN in the alignment direction in positions in the alignment direction D1. The complementary dots DT1 and DT2 which have different positions in the alignment direction D1 are formed and thereby, a streak of unevenness 800 as illustrated in FIG. 15 is prevented.

In addition, the complementary dots are formed at a ratio corresponding to a percentage of the distance between the defective nozzle LN and the first complementary nozzle NZ1 in the alignment direction D1 and the distance between the defective nozzle LN and the second complementary nozzle NZ2 in the alignment direction D1. In this rate, the error length e obtained by subtracting the data shift length s from the shift length δ between chips is reflected. Further, the ratio of the complementary dots from the main complementary nozzle NZm closer to the defective nozzle LN is higher than the ratio of the complementary dots from the sub complementary nozzle NZs far from the defective nozzle LN. Hence, the dot formed by the defective nozzle LN is appropriately complemented.

In the above embodiments, a case in which a defective nozzle is present in the overlap section 212 in the chip 61*a* is described; however, even in a case in which a defective nozzle is present in the overlap section 212 in the chips 61*b* to 61*d*, similarly, it is possible to complement the dot formed by the defective nozzle LN by the complementary nozzle of the adjacent chip.

In addition, when the distance between the defective nozzle LN and the first complementary nozzle NZ1 in the alignment direction D1 is the same as the distance between the defective nozzle LN and the second complementary nozzle NZ2 in the alignment direction D1, for example, the complementary dots may be formed at a ratio of 1 to 1 through the complementary nozzles NZ1 and NZ2. Such a case is included in this technology.

(3) MODIFICATION EXAMPLE

According to the invention, various modification examples may be considered.

For example, a printer to which this technology can be applied includes not only a line printer, but also a multi-head type serial printer in which a plurality of chips (for example, chips 61*a* to 61*d* illustrated in FIG. 4), in which a part of nozzle rows are overlapped, are mounted on a carriage. In the serial printer, when an ink droplet is discharged and a dot is formed, the recording substrate does not move but the plurality of chips move. Hence, the relative movement of the plurality of chips and the recording substrate includes at least a case where a plurality of chips do not move but the recording substrate moves and a case where the recording substrate does not move but the plurality of chips move.

In addition, the recording apparatus to which this technology can be applied includes a photocopier, a facsimile, or the like.

The color of ink may not have a part of CMYK and, in addition to CMYK, may include at least a part of light cyan (lc), light magenta (lm), dark yellow (dy), light black (lk), light light black (llk), orange (Or), green (Gr), blue (B), violet (V), or the like.

In addition, the ink is not limited to a liquid for expressing color, but includes a liquid of achromatic color with glossiness and various liquids which impart any function. Hence, ink droplet includes a liquid droplet of achromatic color and various liquid droplets.

Even in a recording apparatus in which the defective nozzle detecting unit U3 is not provided, the basic effects of this technology is achieved.

Incidentally, when it is possible to input information representing the shift length δ between chips to the recording apparatus 1, the distribution mask MA1 is set and corrected even when a service man or a user replaces the head 61 or the like and the shift length δ between chips is changed, and thereby, it is possible to maintain a good complementary accuracy of a dot formed by the defective nozzle LN.

FIG. 14 is illustrates an example of a distribution mask setting process in which the distribution mask MA1 is set. The controller 10 that performs the distribution mask setting process configures the shift length input unit U2 together with the operation panel 73.

When the distribution mask setting process is started, the recording apparatus 1 receives an input of a measurement value of a shift length δ between chips from the operation panel 73 (S302). Next, the controller 10 determines a data shift length s as illustrated in FIG. 8, causes the shift length to be stored in the non-volatile memory 30, and causes the drive signal transmitting unit 46 to perform data shift process depending on the shift length s (S304). Further, the controller 10 determines rounded error length e based on the shift length δ and the shift length s, determines the distribution ratio Rm or Rs to the main complementary nozzle NZm and to sub complementary nozzle NZs based on the error length e, and generates a distribution mask MA1 based on the distribution threshold value TH1 and the distribution ratio (S306). Finally, the controller 10 causes the distribution mask MA1 to be stored in the non-volatile memory 30 (S308).

Then, when the printing process illustrated in FIG. 13 is performed, a ratio (Rm) of the complementary dot DT1 that is formed by the first complementary nozzle NZ1 to the entirety of the complementary dots DT1 an DT2 formed by the first complementary nozzle NZ1 and the second complementary nozzle NZ2 becomes a ratio according to the shift length 8 which is represented by the distribution mask MA1 newly stored.

As above, even when a service man or the like replace the head 61 or the like and the shift length 8 between the chips is changed, information representing the shift length δ is input and thereby, a ratio of the complementary dots formed by the main complementary nozzle NZm and the sub complementary nozzle NZs becomes the ratio according to the shift length δ represented by the information newly input. Hence, according to this modification example, convenience is improved and it is possible to maintain an effect of appropriately preventing a streak of unevenness by the defective nozzle LN.

(4) CONCLUSION

As described above, according to various aspects of the invention, it is possible to provide a technology or the like which can more appropriately complement a dot formed by the defective nozzle. Needless to say, the technology or the like that includes only the configurational requirements according to the independent claims without including the configurational requirements according to the dependent claims achieves the basic action and effects described above.

In addition, a configuration in which configurations disclosed in the embodiments and the modification examples described above are replaced with each other or the combination is modified, a configuration in which known technologies and configurations disclosed in the embodiments and the modification examples described above are replaced with each other or the combination is modified, or the like can be embodied. The invention includes these configurations or the like.

What is claimed is:

1. A recording apparatus that includes at least a first nozzle row and a second nozzle row that are aligned in a predetermined alignment direction, the first nozzle row including a first plurality of nozzles that are overlapped in the alignment direction with a second plurality of nozzles of the second nozzle row, and the first and second nozzle rows and a recording substrate relatively move in a relative movement direction different from the alignment direction, the recording apparatus comprising:

a processing unit that, when a defective nozzle which forms a defective dot is included in the plurality of first nozzles of the first nozzle row, causes a first closest nozzle of the second nozzle row that is located proximate to the defective nozzle to be selected as a first complementary nozzle and a second closest nozzle of the second nozzle row that is located proximate to the defective nozzle to be selected as a second complementary nozzle, wherein complementary dots that complement a dot which is supposed to be formed by the defective nozzle are formed by the first complementary nozzle and the second complementary nozzle, and wherein the processing unit sets a ratio of complementary dots formed by the first complementary nozzle with respect to complementary dots formed by the first complementary nozzle and the second complementary nozzle to be a ratio obtained depending on a distance between the defective nozzle and the first complementary nozzle in the alignment direction.

2. A recording apparatus that includes at least a first nozzle row and a second nozzle row that are aligned in a predetermined alignment direction, the first nozzle row including a first plurality of nozzles that are overlapped in the alignment direction with a second plurality of nozzles of the second nozzle row, and the first and second nozzle rows and a recording substrate relatively move in a relative movement direction different from the alignment direction, the recording apparatus comprising:

a processing unit that, when a defective nozzle which forms a defective dot is included in the plurality of first nozzles of the first nozzle row, causes a first closest nozzle of the second nozzle row that is located proximate to the defective nozzle to be selected as a first complementary nozzle and a second closest nozzle of the second nozzle row that is located proximate to the defective nozzle to be selected as a second complementary nozzle, wherein complementary dots that complement a dot which is supposed to be formed by the defective nozzle are formed by the first complementary nozzle and the second complementary nozzle, and wherein the processing unit sets a ratio of complementary dots formed by a nozzle closer to the defective nozzle in positions in the alignment direction between the first complementary nozzle and the second complementary nozzle to be higher than a ratio of complementary dots formed by a nozzle far from the defective nozzle.

3. The recording apparatus according to claim 1, wherein the processing unit includes a data shift unit that relatively shifts first nozzle data which enables a dot to be formed by the first nozzle row and second nozzle data which enables a dot to be formed by the second nozzle row in the alignment direction at a nozzle unit and thereby, causes a shift of the first nozzle row and the second nozzle row in the alignment direction to become smaller in data with respect to a reference, and forms complementary dots by the first complementary nozzle and the second complementary nozzle based on the relatively shifted first nozzle data.

4. The recording apparatus according to claim 3, wherein the processing unit causes complementary dots to be formed by the first complementary nozzle and the second complementary nozzle at a ratio obtained depending on an error length obtained by subtracting a relative shift length between the first nozzle data and the second nozzle data by the data shift unit from a shift length of the first nozzle row and the second nozzle row with respect to the reference.

5. The recording apparatus according to claim 1, further comprising:

a storage unit that stores distribution information in which complementary dots to be formed is formed at a ratio obtained depending on a distance between the defective nozzle and the first complementary nozzle in the alignment direction, wherein the processing unit causes complementary dots to be formed by the first complementary nozzle and the second complementary nozzle in accordance with the distribution information.

6. The recording apparatus according to claim 1, further comprising:

a shift length input unit that inputs information indicating a shift length of the first nozzle row and the second nozzle row with respect to a reference, wherein the processing unit sets a ratio of a complementary dot formed by the first complementary nozzle with respect to complementary dots formed by the first complementary nozzle and the second complementary nozzle to be a ratio obtained depending on a shift length indicated by the information input by the shift length input unit.

7. A recording method in which a plurality of nozzle rows in which a plurality of nozzles are aligned in a predetermined alignment direction are used and the plurality of nozzle rows and a recording substrate relatively move in a relative movement direction different from the alignment direction, the recording method comprising:

partially overlapping, in the alignment direction, the nozzles of a first nozzle row and a second nozzle row which are included in the plurality of nozzle rows, including a defective nozzle which forms a defective dot in the nozzles in an overlap section of the first nozzle row with the second nozzle row, selecting, as a first complementary nozzle, the nozzle of the second nozzle row that is closest to the defective nozzle and selecting, as a second complementary nozzle, another nozzle of the second nozzle row that is next closest to the defective nozzle, forming, by the first complementary nozzle and the second complementary nozzle, complementary dots that complement a dot which is supposed to be formed by the defective nozzle, and setting a ratio of complementary dots formed by the first complementary nozzle with respect to complementary dots formed by the first complementary nozzle and the second complementary nozzle to be a ratio obtained depending on a distance between the defective nozzle and the first complementary nozzle in the alignment direction.

* * * * *